US011072513B2

(12) United States Patent
Sulik et al.

(10) Patent No.: US 11,072,513 B2
(45) Date of Patent: Jul. 27, 2021

(54) ROLLED WEB MATERIAL DISPENSER MATERIAL LOCKOUT SYSTEMS

(71) Applicant: San Jamar, Inc., Elkhorn, WI (US)

(72) Inventors: Jarod Sulik, Elkhorn, WI (US); Bernie Ziebart, Pewaukee, WI (US)

(73) Assignee: San Jamar, Inc., Elkhorn, WI (US)

( * ) Notice: Subject to any disclaimer, the term of this patent is extended or adjusted under 35 U.S.C. 154(b) by 0 days.

(21) Appl. No.: 16/828,293

(22) Filed: Mar. 24, 2020

(65) Prior Publication Data

US 2020/0307949 A1 Oct. 1, 2020

Related U.S. Application Data

(63) Continuation-in-part of application No. 16/368,191, filed on Mar. 28, 2019.

(51) Int. Cl.

| | |
|---|---|
| ***B65H 75/26*** | (2006.01) |
| ***B65H 16/00*** | (2006.01) |
| ***B65H 16/04*** | (2006.01) |

(52) U.S. Cl.

CPC ..... *B65H 75/26* (2013.01); *B65H 16/005* (2013.01); *B65H 16/04* (2013.01)

(58) Field of Classification Search

CPC ..... A47K 10/3845; A47K 2010/3675; A47K 10/38; A47K 10/36; B65H 75/185; B65H 75/26; B65H 16/005; B65H 16/04

USPC ..... 242/599.1, 599.4, 596.7, 597.5, 597.6

See application file for complete search history.

(56) References Cited

U.S. PATENT DOCUMENTS

| | | | | |
|---|---|---|---|---|
| 1,716,812 | A | 6/1929 | Ball | |
| 3,552,669 | A | 1/1971 | Earnest | |
| 4,108,513 | A | 8/1978 | Lander | |
| 4,557,426 | A | 12/1985 | Siciliano | |
| 5,310,129 | A | 5/1994 | Whittington et al. | |
| 5,636,812 | A | 6/1997 | Conner et al. | |
| 6,390,410 | B1 * | 5/2002 | LaCount | A47K 10/40 242/571.5 |
| 6,491,251 | B1 | 12/2002 | Stanland et al. | |
| 6,648,267 | B2 | 11/2003 | Stanland et al. | |
| 6,874,958 | B1 * | 4/2005 | Panebianco | B41J 15/02 242/358.1 |

(Continued)

FOREIGN PATENT DOCUMENTS

EP 1064876 B1 3/2005

*Primary Examiner* — William A. Rivera
(74) *Attorney, Agent, or Firm* — Boyle Fredrickson S.C.

(57) ABSTRACT

A lockout system that is configured to limit use of a rolled web material dispenser assembly to dispense only authorized rolls of web material. The lockout system includes respective first and second mating registration elements that removeably cooperate with one another and provide a rotational cooperation therebetween when engaged with one another. One of the registration elements is associated with each authorized roll of web material and the mating registration element is associated with the rolled web material dispenser assembly. The first registration element defines an insert engaged with a bore of discrete authorized rolls of web material. The corresponding and mating second registration element defines a hub that is supported by the roll dispenser. Mating of the first and second registration elements provides a rotatable linkage that facilitates rotation of the roll relative to the dispenser assembly during the dispense activity.

20 Claims, 29 Drawing Sheets

(56) References Cited

U.S. PATENT DOCUMENTS

| | | | | |
|---|---|---|---|---|
| 7,014,140 | B2 | 3/2006 | Elliott et al. | |
| 7,044,419 | B2 | 5/2006 | Moore | |
| 7,114,676 | B2 | 10/2006 | Elliott et al. | |
| D543,402 | S | 5/2007 | Goeking et al. | |
| D543,745 | S | 6/2007 | Goeking et al. | |
| D556,482 | S | 12/2007 | Goeking et al. | |
| 7,461,810 | B2 | 12/2008 | Goeking et al. | |
| 8,356,767 | B2 | 1/2013 | Formon et al. | |
| 8,479,957 | B2 | 7/2013 | Ophardt | |
| 2001/0054667 | A1* | 12/2001 | Komatsu | B65H 75/08 242/596.1 |
| 2007/0063092 | A1* | 3/2007 | Zevin | B65H 16/06 242/571.5 |
| 2009/0283623 | A1* | 11/2009 | Yamada | B41J 15/02 242/596.7 |
| 2012/0138723 | A1* | 6/2012 | Lewis | A47K 10/38 242/160.4 |
| 2015/0150422 | A1* | 6/2015 | Ochoa, Sr. | A47K 10/16 242/596.7 |
| 2015/0305578 | A1* | 10/2015 | Keily | A47K 10/38 242/419.9 |
| 2020/0307949 | A1* | 10/2020 | Sulik | A47K 10/3845 |

* cited by examiner

ROLLED WEB MATERIAL DISPENSER MATERIAL LOCKOUT SYSTEMS

CROSS-REFERENCE TO RELATED APPLICATIONS

This is a continuation-in-part non-provisional patent application and claims priority to U.S. Non-provisional patent application Ser. No. 16/368,191 filed on Mar. 28, 2019 titled "Rolled Web Material Dispenser Material Lockout Systems", and the disclosure of which is expressly incorporated herein.

BACKGROUND OF THE INVENTION

The present invention is generally directed to a dispenser product lockout system and, more particularly, to a rolled web material dispenser having a mechanical lockout feature that prevents use of a dispenser assembly for dispensing rolled web material that is acquired from non-approved or unauthorized sources.

Conventional rolled web material dispensers for use in dispensing hand towel and toilet tissue material or the like often advance the web material from a roll as the roll rotates about a spindle, bobbin, or hub located within the dispenser. Upon depletion of the rolled web material, the dispenser housing is opened, and a replacement roll of web material is then placed within the dispenser. Conventional rolls of web materials may be coreless or include a hollow core for receiving a generic or common spindle that extends laterally through the core and whose opposing ends are supported by the dispenser housing. When provided in a coreless configuration, the axially opposing end located portions of the web material may be pinched between opposing fingers or compression assemblies that collectively define the rotational axis of the roll of web material relative to the dispenser.

Whether provided in a cored or coreless configuration of rolled web material, conventional paper and web material roll dispensers are not commonly configured to selectively dispense only a particular type, style, or roll of web material or a roll of web material from a particular manufacturer. Accordingly, it is possible for a size discrepancy or mismatch to occur between the dispenser and the roll of web material, thereby inhibiting the proper dispensing of the web material.

Such systems also present the potential that service providers or employees may configure such dispensers to dispense product having less desirable construction or performance characteristics via cheaper source suppliers or the like. Shortcomings in the dispense operation can sometimes be incorrectly attributed to subpar operability of the dispenser assembly rather than being attributable to deviations in the manufacture of the discrete rolled web material and/or use of rolled web materials that are ill-suited for being dispensed from a given dispenser assembly or produced with subpar manufacturing practices. Improper or less than efficient operation of the rolled web material dispenser to dispense rolled web material in a repeatable manner, but attributable to improper loading or use of a dispenser with web material not properly configured for cooperation with a discrete dispenser assembly, may reflect adversely on the manufacturer of the dispenser rather the establishment or service provider associated with maintaining operation of the discrete dispenser assemblies once deployed and ensuring that only suitable rolled web materials are associated therewith. Accordingly, there is a need for a roll dispenser that is constructed to limit use of the dispenser assembly to dispense only desired rolled web materials and thereby inhibit use of the dispenser assembly to dispense rolls of web material that have not be authorized to be dispensed from the corresponding dispenser.

Further, a need exists for lockout features that prevent necessary positioning or support of unauthorized rolls of web material relative to a given dispenser. In such a lockout system, in the event that there is an inconsistency between a registration component associated with a core of the roll and a mating registration portion associated with the hub or spindle of the dispenser, the roll of material will not be accepted into the dispenser in an operable manner thereby inhibiting use and/or proper support for dispensing of an unauthorized roll of web material.

A further need exists for a lockout roll dispensing system that is relatively inexpensive to manufacturer, produce, and maintain in a useable condition, inhibits use of unauthorized rolls of web materials, and solves other problems associated with existing configurations. A still further need exists for a dispenser assembly roll of web material lockout system that can be quickly and conveniently implemented into existing or previously deployed dispenser assemblies and which includes separable elements that can be configured to designate rolls of web material as authorized to be dispensed with dispenser assemblies that have been reconfigured to include the lockout system. A need further exists for roll web material lockout systems that provide robust support of authorized materials to facilitate the sequential rotational dispensing of the web material from the bulk roll. A further need exists for rendering a dispenser assembly incapable of supporting those rolled web material rolls that do not include the mating registration element.

SUMMARY OF THE INVENTION

The present invention discloses a roll of web material lockout system that resolves one or more of the shortcomings disclosed above.

One aspect of the present application discloses a web material roll lockout system for use in a dispenser that includes a core insert configured to be disposed within a core of the web material roll, where the core insert comprising a first registration element. The system further includes an adapter configured to rotatably receive the core insert, where the adapter comprises a second registration element mating with the first registration element when the core insert is rotatably received at the adapter. A linkage configured to support the web material roll is formed in the system by the mating of the first and second registration elements.

Another aspect of the present application discloses the first registration element formed of a plurality of spaced apart projections and the second registration element formed of a corresponding plurality of spaced apart slots that have an outer perimeter that corresponds to the shape of the projections.

Another aspect of the present application discloses that the first registration element consists of a plurality of radially located flexible space apart projections extended generally perpendicular to an axis of rotation of the core insert that define a space therebetween, and the second registration element consists of a hub configured to snap-fit between the flexible spaced apart projections.

Still another aspect of the present application discloses at least one projection extending forwardly of a front surface of the adapter and configured to frictionally engage a lateral edge of the web material roll as to inhibit or break rotational movement thereof.

Still another aspect of the present application discloses the adapter including a seat rotatably fixed to the dispenser and a rotatable disc disposed between the seat and the core insert, and wherein the second registration element is disposed within the rotatable disc.

Still another aspect of the present application discloses a roll mounting arrangement having an insert that is constructed to removeably cooperate with a hub associated with an underlying dispenser assembly and wherein more the one rotational bearing surfaces are formed between the insert and the hub. In a preferred aspect, the multiple bearing surfaces are oriented at different respective axial and radial locations relative to one another to improve the robust nature associated with the rotational engagement between the discrete hub and insert.

A further aspect of the present application discloses a web material lockout arrangement wherein at least one of the registration elements associated with the roll of web material and the underlying dispenser assembly is movable in an axial direction relative to the other registration. The movable registration element is biased toward and accessible position and moveable to a retracted position. Registration elements that are constructed to operatively cooperate with one another can engage one another to facilitate dispensing of web material. If it is attempted to load the dispenser with a roll of web material that does not include a mating registration element, the movable registration element translates toward the retracted position thereby preventing engagement between the unmatched registration elements in a manner that would facilitate dispensing of the unauthorized roll of web material.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
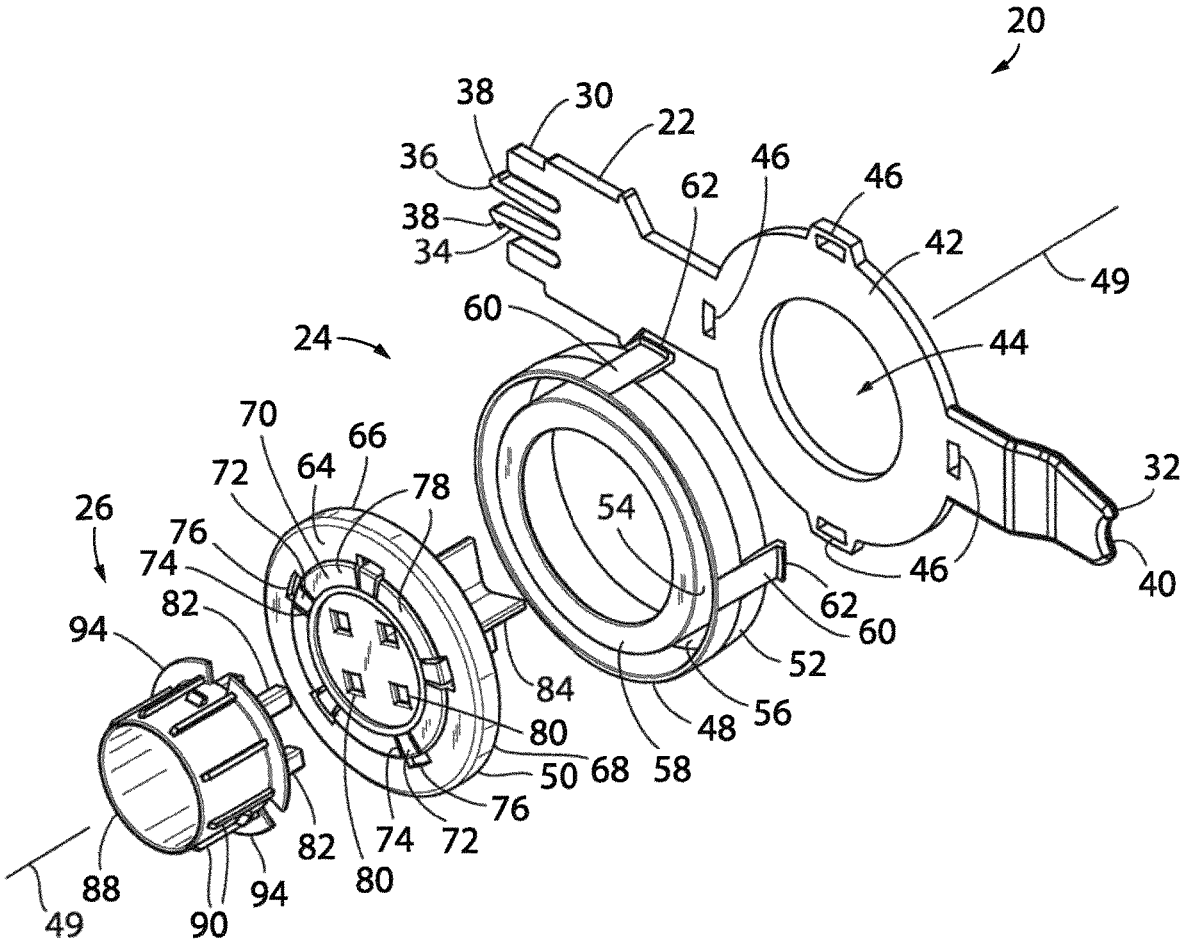
FIG. 1 is an exploded perspective view of a rolled web material lockout system for use in a rolled web material dispenser and according to one embodiment of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

The various features and advantageous details of the subject matter disclosed herein are explained more fully with reference to the non-limiting embodiments described in detail in the following description.

Illustrative embodiments of rolled web material lockout systems in accordance with various aspects of the present invention are shown in FIG. 1 through FIG. 17. FIGS. 1-8, and initially FIG. 1, shows a rolled material lockout system 20 according to a first embodiment of the invention and constructed to cooperate with a rolled web material dispenser as disclosed further below with respect to FIG. 17. Roll lockout system 20 includes a hub or roll support arm 22, an adapter 24 and a core insert 26. As disclosed further below with respect to FIGS. 8 and 17, roll support arm 22 is preferably constructed to snap-fittingly cooperate with a housing or enclosure of a dispenser or dispenser assembly 28 configured to dispense rolled web material in an unwinding or unrolling manner.

The roll support arm 22 extends in a generally linear manner along a length from a first end 30 to an opposing second end 32. The first end 30 of the roll support arm 22 includes a first and preferably a second resilient catch arm 34, 36, which each contains a respective opposing barb 38 formed proximate an end thereof and that is configured to releasably engage a receiving slot formed in the dispenser assembly 28. Each support arm 22 is preferably constructed to cooperate with dispenser assembly 28 in a snap-fit manner. The opposing second end 32 of the roll support arm 22 has an arcuate depression 40 that is configured to allow a user to selectively deflect the respective support arm 22 in a generally outward lateral direction relative to one another to aid in the association of an authorized roll with dispenser assembly 28 or the removal of the core of spent or consumed roll therefrom. It is further appreciated that opposing second end 32 could be configured to cooperate with an interior facing surface of a cover of dispenser assembly 28 when the cover is oriented in a closed position. Such a consideration allows the weight of the rolled web material to be distributed over both ends 30, 32 of each respective roll support arm 22. Alternatively, it is appreciated that support arms 22 are constructed to support the opposing ends of a discrete roll of web material in a cantilevered fashion relative to end 30 and the housing of dispenser assembly 28 as disclosed further below with respect to FIG. 17.

An adapter receiving area 42 is disposed along a front or roll facing surface of the length of the roll support arm 22 between the first and second ends 30, 32. As shown in FIG. 1, the adapter receiving area 42 in one embodiment of the present invention is generally circular having a hollow center or void 44 therein. However, it should be understood that the present invention is not so limited and that any alternative configuration of the adapter receiving area 42 is considered within the scope of the present invention. Still referring to FIG. 1, the adapter receiving area 42 of support arm 22 includes a plurality of receiving slots 46 that are annularly disposed proximate the perimeter of the adapter receiving area 42 for receiving and mating to the adapter 24 as described further below.

Turning now to the adapter 24, and still referring to FIG. 1, the adapter 24 is formed of a seat 48 and a mating disc 50, wherein the disc 50 is configured to rotate along its central axis 49 within the seat 48, which is configured to remain in a fixed position relative to the roll support arm 22. It is appreciated that axis 49 defines the longitudinal or axial axis of rotation of a roll of web material associated with the dispenser assembly. Although adapter 24 is defined by seat 48 and disc 50, it is appreciated that adapter 24 can formed by other numbers of cooperating members or formed as a single integral structure as disclosed further below with respect to the embodiment disclosed in FIGS. 9-16.

Still referring to FIG. 1, the seat 48, which is generally circular in cross-section, comprises an annular outer wall 52, a spaced apart annular inner wall 54 and a channel 56 located between the outer and inner walls 52, 54. A disc receiving surface 58 may extend about the front or roll facing side or edge of the annular inner wall 54, approximately perpendicularly thereto, which is configured to engage a rear or laterally outboard facing surface of the disc 50 when the roll lockout system 20 is assembled as disclosed further below. Additionally, and still referring to FIG. 1, the seat 48 of the adapter 24 also includes a plurality of resilient catch fingers 60 that are annularly disposed about a rearward facing edge of the outer wall 52, and which are configured to deflect while passing through and as to be frictionally retained within the receiving slots 46 that are annularly disposed about the perimeter of the adapter receiving area 42. That is to say, after passing the respective resilient catch fingers 60 through the corresponding respective slots 46, an outwardly direct barb 62 on the end of each finger 60 prevents disengagement of the seat 48 of the adapter 24 from the adapter receiving area 42. In this configuration the seat 48 is releasably affixed to the front or roll facing surface of the adapter receiving area 42 of the roll support arm 22 while simultaneously inhibiting rotation of the seat 48 relative to the respective support arm 22.

Still referring to FIGS. 1-8, and primarily FIG. 1, the disc 50 that is configured to be received at the mating disc 50 will now described in further detail. The disc 50 comprises a width extending between a roll facing or front surface 64 and an opposing or laterally outboard facing or a rear surface 66. An outer rim 68 of disc 50 extends about perimeter of the disc 50 in a rearward direction. A mounting ring 70 is disposed toward the roll facing or front surface 64 of the disc 50, generally at a position between the outer rim 68 and a center of the disc 50. The mounting ring 70 includes a plurality of spaced apart deflectable mounting tabs 72 that each extend from a first interior end 74 that is affixed to the disc 50 to a cantilevered or free opposing second end 76 that is moveable relative to the disc 50, such that the tabs 72 may be flexed or resiliently depressed. The mounting tabs 72, which are radially spaced about the circumference of the mounting ring 70 and are interspersed by a plurality of core insert flange mating surfaces 78, extend generally in a radially outboard or rearward direction a distance behind the rear surface 66 of the disc 50.

Figure 2:
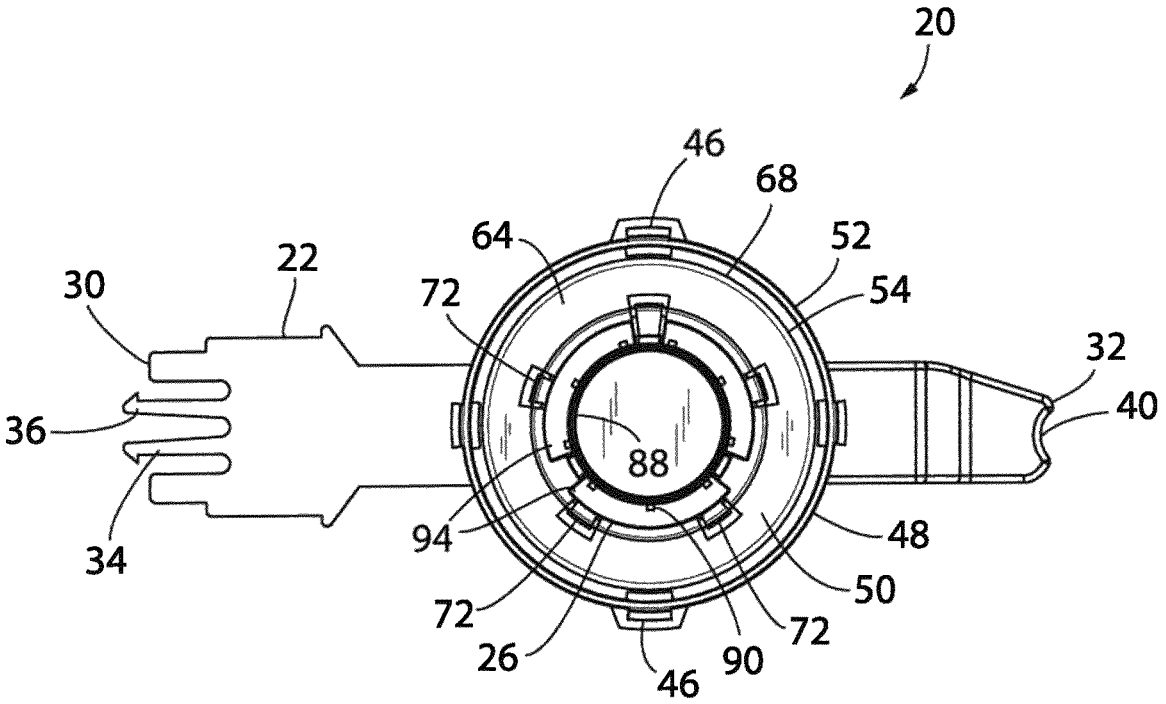
FIG. 2 is a roll facing elevation view of the assembled lockout system shown in FIG. 1.
Figure 3:
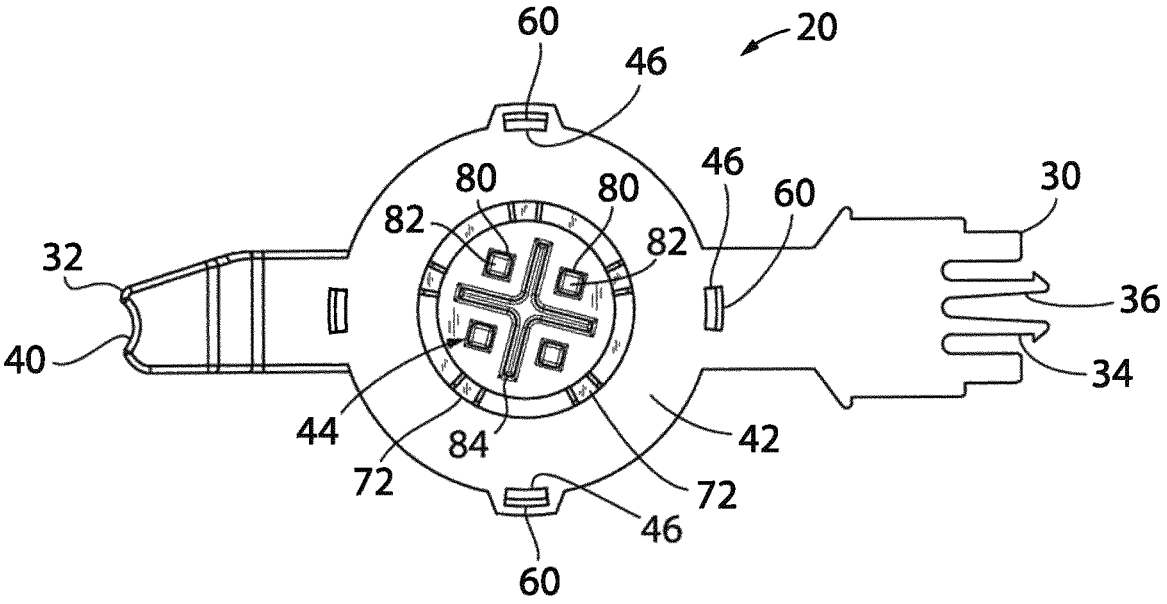
FIG. 3 is a laterally outboard side facing elevation view of the assembled lockout system shown in FIG. 1.
Figure 4:
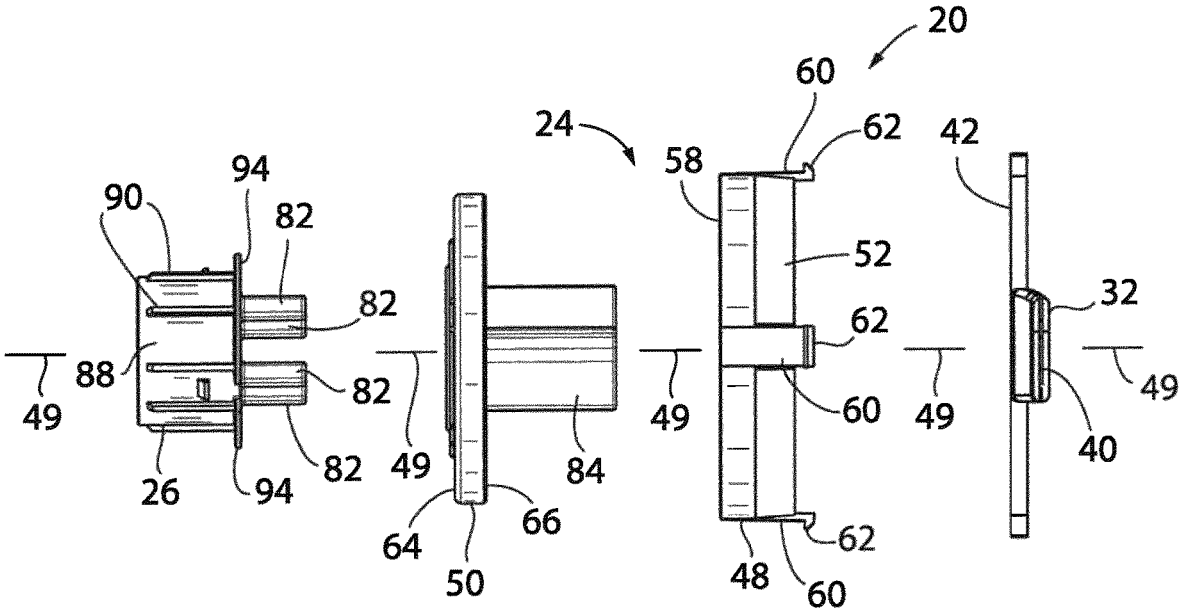
FIG. 4 is a front side exploded elevation view of the lockout system shown in FIG. 1.
Figure 5:
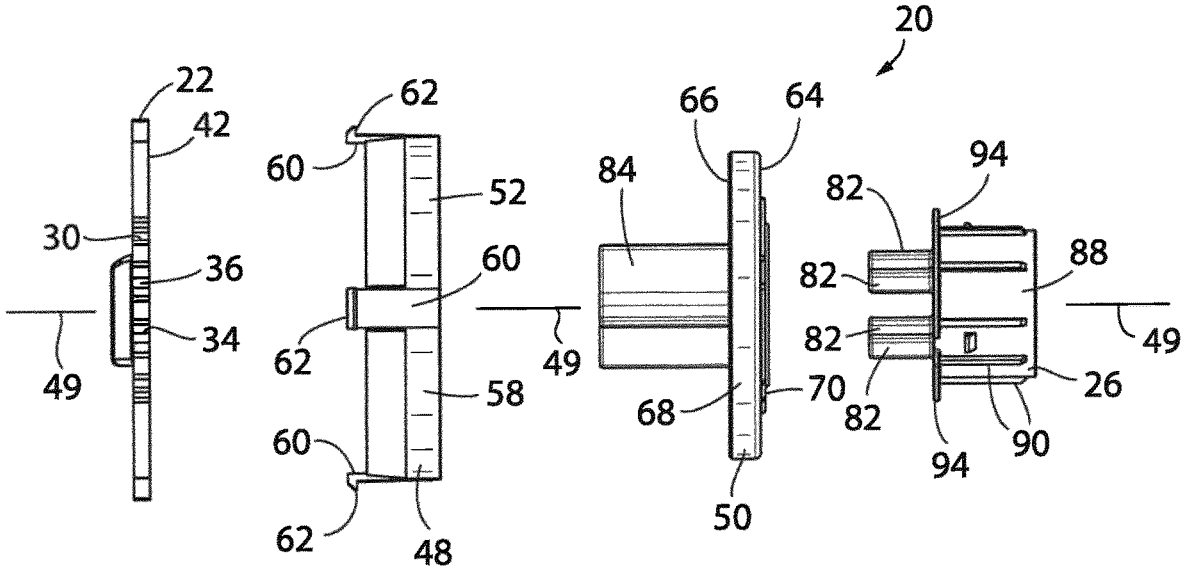
FIG. 5 is a rear side exploded elevation view of the lockout system shown in FIG. 1.
Figure 6:
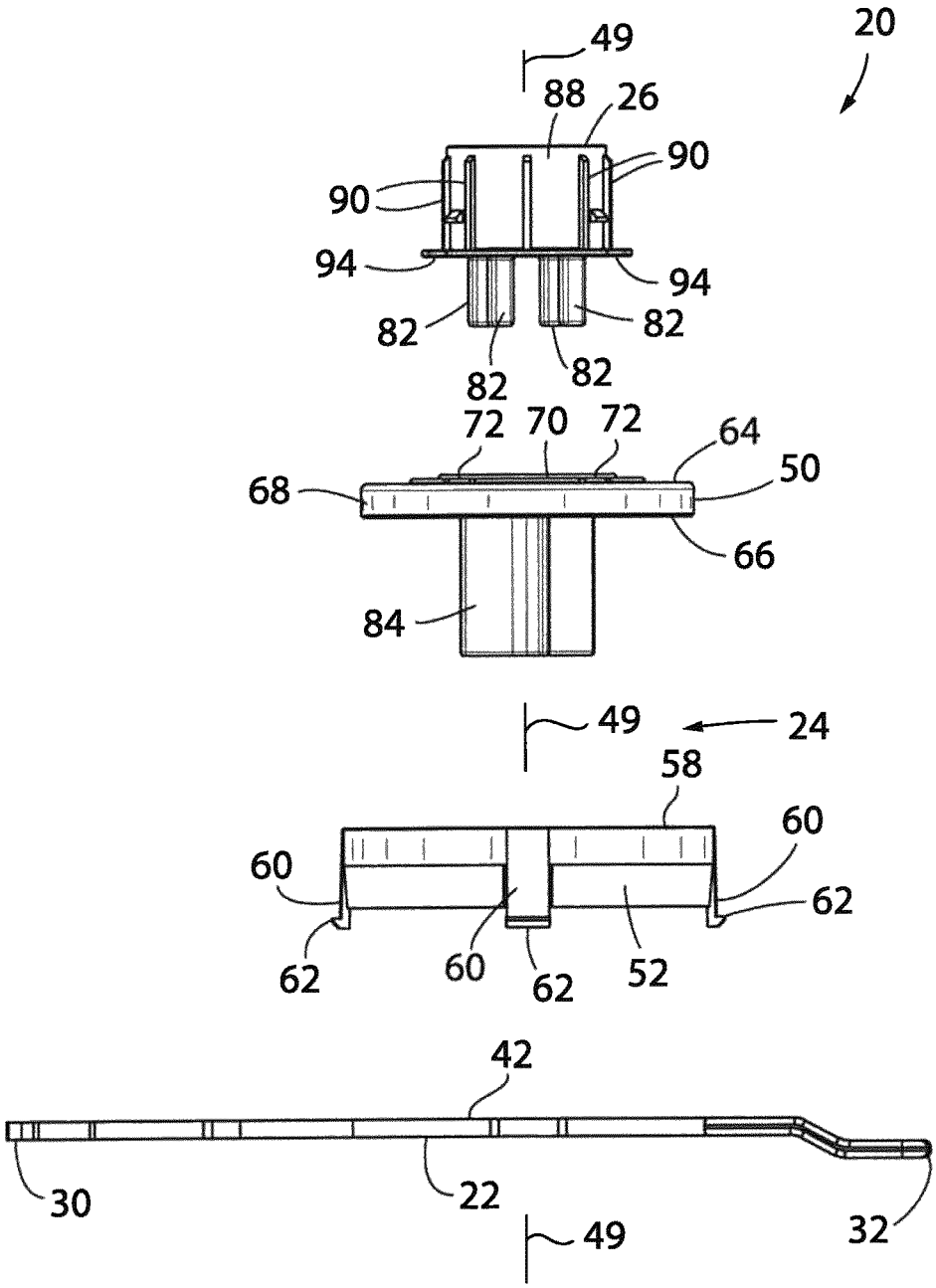
FIG. 6 is a top plan exploded view of the lockout system shown in FIG. 1.
Figure 7:
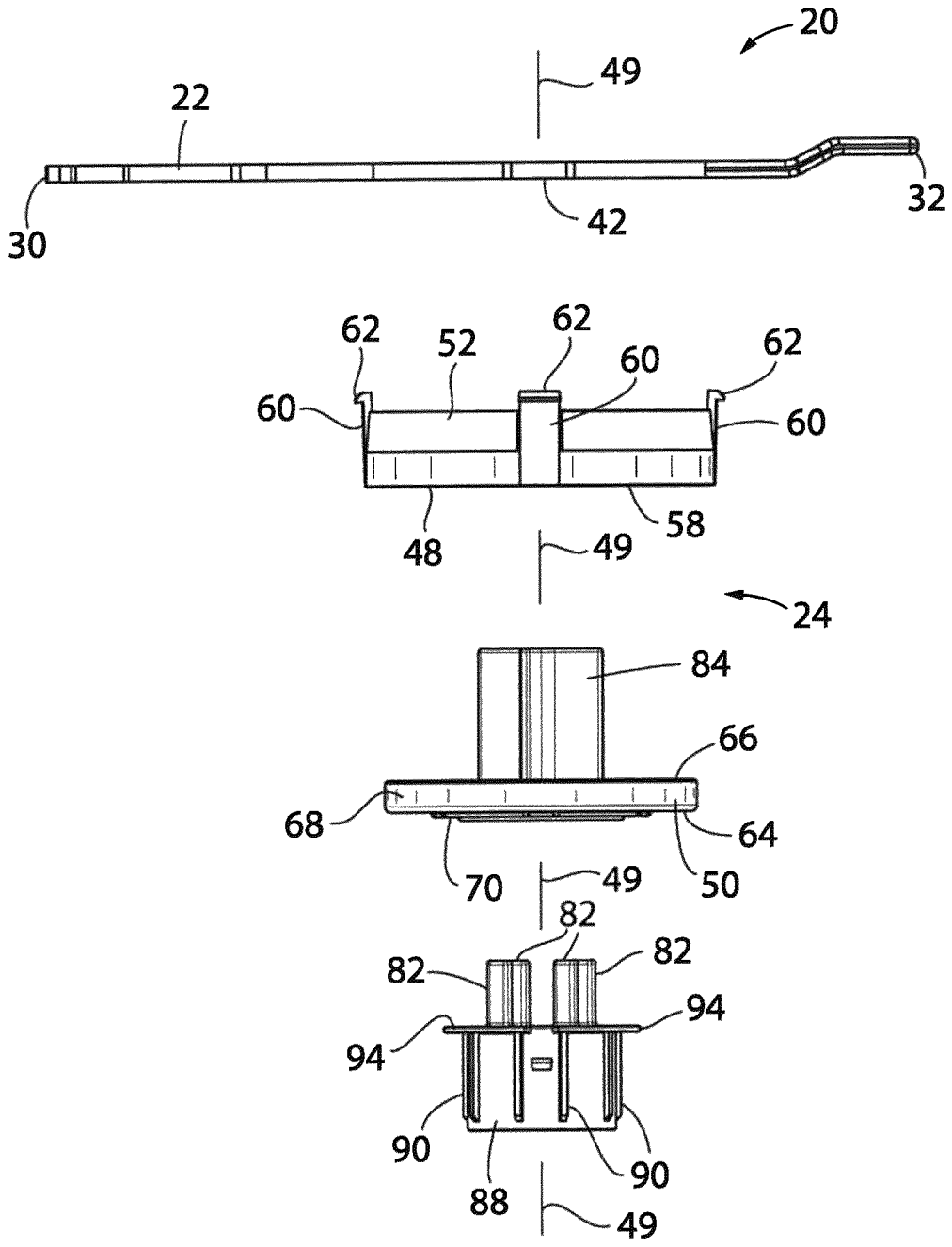
FIG. 7 is a bottom plan exploded view of the lockout system of FIG. 1.
Figure 8:
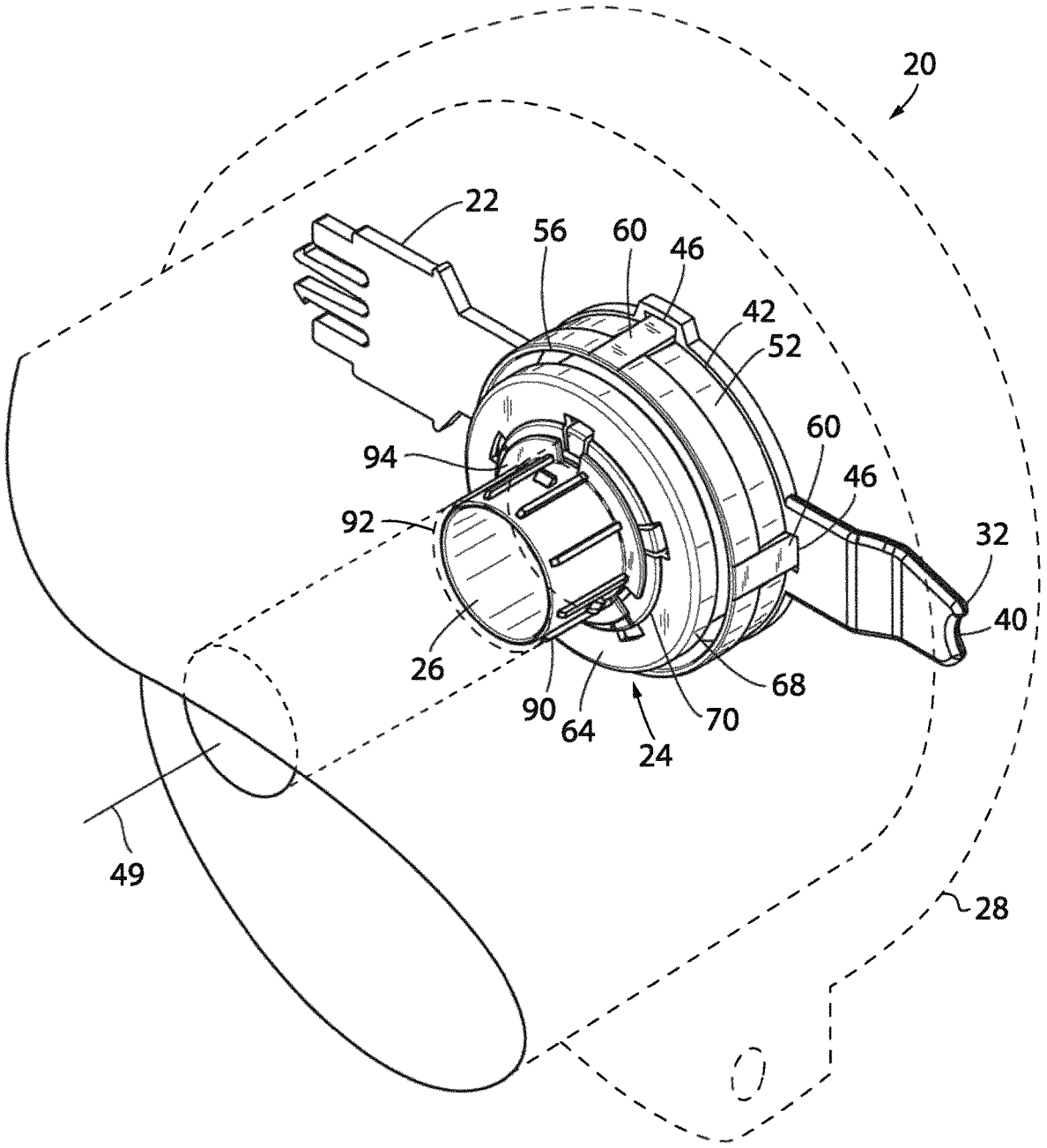
FIG. 8 is a front perspective view of the assembled lockout system of FIG. 1 with a phantom roll of authorized web material associated therewith.

As shown in FIGS. 2, 3, and 8, when the roll lockout system 20 is assembled, the disc 50 cooperates with seat 48 such that disc 50 is rotatable relative thereto. More specifically, the outer rim 68 of the disc 50 is received within the channel 56 of the seat 48 and the rear surface 66 of the disc 50 is pressed rearward into contact with the disc receiving surface 58 until the second end 76 of each of the mounting tabs 72 deflects in an inward radial direction such that continued axial translation of the disc 50 in the rearward or outboard axial direction allows each mounting tab 72 to deflect over and subsequently engage the rearward or axially outboard facing surface of the disc receiving surface 58. In such an orientation, the disc 50 is affixed to the seat 48 such that disc 50 is rotatable relative to seat 48 but is secured in an axial location relative to seat 48 and thereby relative to arm 22. Preferably, tabs 72 are configured to snap-fittingly cooperate with the radially inward directed edge of surface 58 in response to an outward axial translation of disc 50 toward seat 48 during assembly of roll lockout system 20.

Returning now to FIG. 1, mounting ring 70 includes one or more of a plurality of indexing or registration elements, i.e., registration slots 80 associated with an interior area of the mounting ring 70 and which are generally positioned about the center of the disc 50. As shown in the exemplary embodiment of FIG. 1, the registration slots 80 may include four slots, each having a generally square cross-sectional area. However, it is appreciated that registration slots 80 according to the present invention could be provided in virtually any number, shape or position relative to mounting ring 70. Any number, shape or position of registration slots 80 are considered within the scope of the appending claims. The registration slots 80 are sized, shaped and positioned to selectively removeably cooperate with corresponding projections or registration posts 82 that extend in an outboard lateral or axial oriented direction from a rear surface of the core insert 26 in a selectively axially associable and rotational mating configuration as will be described in further detail below.

Disc 50 includes a plurality of walls that collectively define a handle 84 that extends in the outboard axial direction relative to rear surface 66 of the disc 50 and towards the void 44 in the adapter receiving area 42 of the roll support arm 22. The handle 84 improves the structural rigidity of disc 50 and may be engaged by a user during loading operation to rotate the disc 50 into a desired position such that registration slots 80 are generally axially aligned with respective registration posts 82 of core insert 26 associated with a roll of web material to simplify the aligning of the registration slots 80 with their mating posts 82 extending from the core insert 26 during dispenser loading operations.

The core insert 26 is configured to be disposed within the hollow core of a roll of web material 86, as shown briefly in FIG. 8. Preferably, core inserts 26 are constructed to be disposed in the hollow area of a roll of web material, whether provided in a cored or coreless configuration and wherein the discrete inserts 26 are not otherwise removable or replaceable relative to discrete rolls of web material without destruction of the discrete core insert. Returning now to FIG. 1, the core insert 26 includes an annular wall 88 having plurality of radially aligned retention barbs 90 extending in a radially outward direction from the outer surface of the annular wall 88. The retention barbs 90 are configured to frictionally engage the core 92 or hollow bore of a roll of web material and improve retention of the core insert 26 within the core 92 of the roll of web material 86.

As alluded to above, core insert 26 is preferably non-removable from a hollow bore or core of a roll of web material without destruction of the core insert 26. To further improve proper positioning of the core insert 26 within the roll core 92, an outer flange 94 extends in an outward radial annular direction about the axially outboard or support facing or rear edge of the wall 88. In use, the outer flange 94 abuts a sidewall associated with the axial end of the roll of web material 86 and prevents the core insert 26 from being placed too deep within the bore or core 92 of the discrete roll of web material during the manufacturing process.

As seen in FIG. 8, the outer flange 94 preferably abuts the core insert flange mating surfaces 78 of the mounting ring 70 on the disc 50, when the roll lockout system 20 is assembled and configured for the supported roll of web material and sequential rotational dispensing operation. The rotational interaction between disc 50 and outer wall 52 or adapter 24 is configured to cooperate with the roll of authorized web material and each other such that, during the dispense operation, the frictional interaction between disc 50 and outer wall 52 prevents over-rotation of adapter 24 and the roll of web material associated therewith relative to dispenser assembly 28 whether the dispense assembly is provided in a manually operable configuration or a powered or touchless dispensing configuration. Such a consideration ensures the repeatable operation of dispenser assembly 28 for the entirety of each discrete authorized roll of web material associated therewith and through consumption of multiple discrete rolls.

Additionally, as was previously described a plurality of registration posts 82 extend in an outboard axial direction from core insert 26 and relative to a roll of web material engaged therewith and are received within the registration slots 80 in a male/female configuration. It is appreciated that the relative orientation of the mail/female engagement interface could be reverse of that shown. That is, it is appreciated that disc 50 could constructed to include a respective male or projecting structure and core insert 26 could be constructed to include a corresponding female or receding or cavity structure configured to slideably receive the corresponding projecting structure to allow a selective axial slideable interaction and cooperating rotational interaction therebetween. It is further appreciated that although posts 82 are each shown as extending in an axial direction that is generally aligned with, albeit offset from, axis 49 and oriented to extend along respective axis that are parallel to axis 49, other orientations of the plurality of projections or posts 82 are envisioned.

Regardless of the specific projection/cavity configuration and/or orientation employed between a respective core insert 26 and corresponding mating disc 50, lockout system 20 is configured such that only rolls of web material 86 that contain a core insert 26 with the proper registration posts 82 size, shape, number, and spacing to mate with the corresponding registration slots 80 of the mating disc 50 will be properly received by the dispenser assembly 28 equipped with a roll lockout system 20 according to the present invention. It is further appreciated lockout system 20 could be provided in a configuration wherein the respective insert, or cooperating disc, could be configured to cooperate with a limited number or group of inserts or discs rather than one insert or disc configuration. Furthermore, in addition to providing mating with the registration slots 80, the registration posts 82 also provide the physical support for core insert 26 and its surrounding roll of web material 86 to be releasably retained by the disc 50. That is to say, that by inserting the registration posts 82 into the registration slots 80, the core insert 26 becomes rotationally linked with the disc 50, such that the rotation of the roll of web material during the dispense operation causes rotation of core insert 26 and thereby rotation of mating disc 50 via communication of the rotational forces through the registration post and slot linkage.

Upon depletion of the roll of web material 86, the dispenser assembly 28 may be opened and the remaining disposable core insert 26, and/or the roll core associated therewith but absent the web material 86, may be discarded or recycled, and a new roll of web material 86 equipped with only a corresponding core insert 26 may be engaged and supported by roll lockout system 20 to effectuate the desired continued and repeatable usage of dispenser assembly 28. It should be further appreciated that the generally planar roll racing surface associated with disc 50 mitigates the potential of user's configuring dispenser assembly 28 for use with rolled web material products that are not equipped with a suitable core insert 26 that is constructed to provide the physical and rotational support of a discrete roll of web material relative to the underlying dispenser assembly 28.

The generally planar or relatively deminimis extension of roll facing surface of disc 50 in the axial direction relative to the axis of rotation thereof provides a construction associated with the roll facing surface of disc 50 mitigates the ability of the user or owner of dispenser assembly 28 to load dispenser assembly 28 with rolled web material product that has not been previously authorized as being suitable for use with dispenser assembly 28. Further, the slideable cooperation of core insert 26 and mating disc 50 allows the user or service personnel to immediately confirm during service or reloading operations that a particular roll of web material is suitable for use with a particular dispenser assembly 28 via confirmation of the presence and appearance of core insert 26 as having a generally mirror image construction of mating disc 50. When deployed, lockout system 20 further allows service personnel to readily affirm whether an issue with a dispenser operation is attributable to dispenser operation or an attempt at use of the discrete dispenser assembly 28 to dispense rolled web material that is of insufficient character so as to have been authorized to be dispensed with the discrete dispenser assembly.

Figure 9:
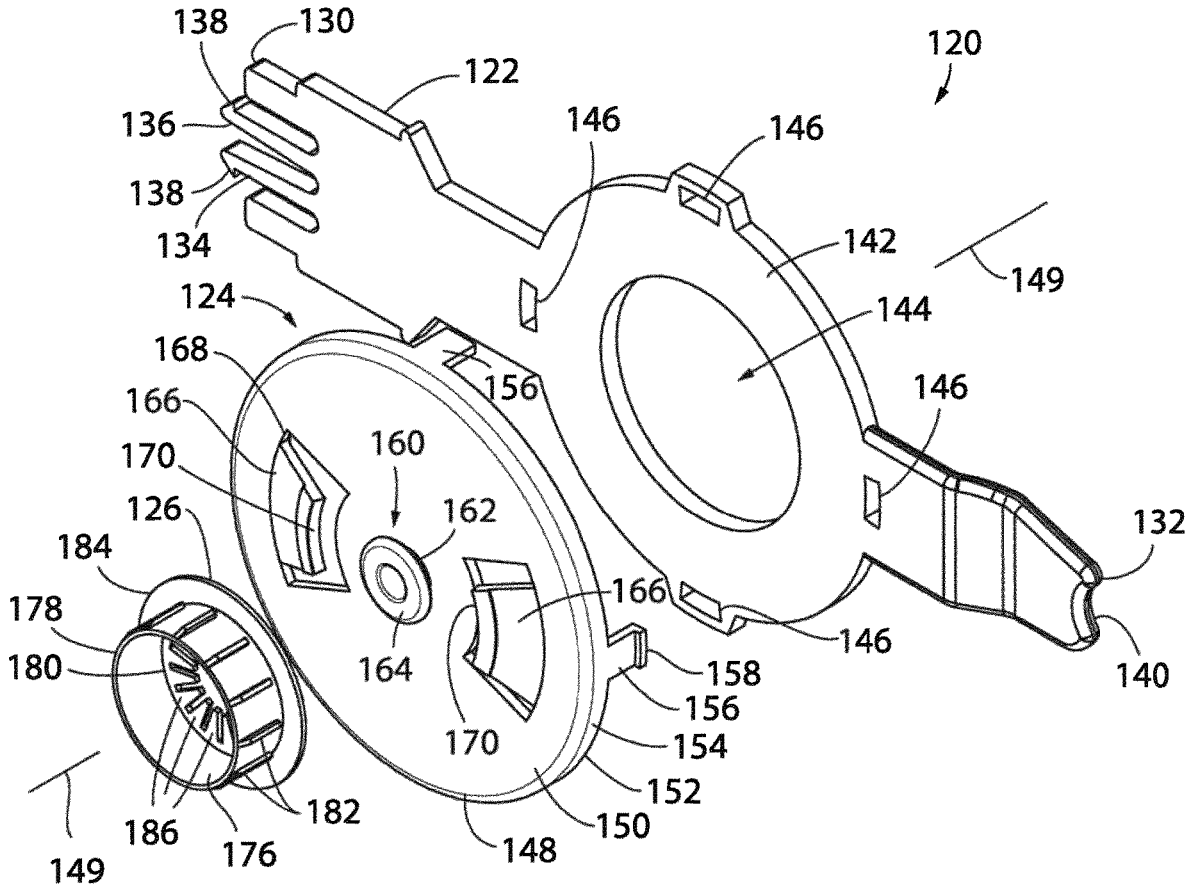
FIG. 9 is an exploded perspective view of a rolled web material lockout system for use in a rolled web material dispenser and according to an alternate embodiment of the present invention.
Figure 10:
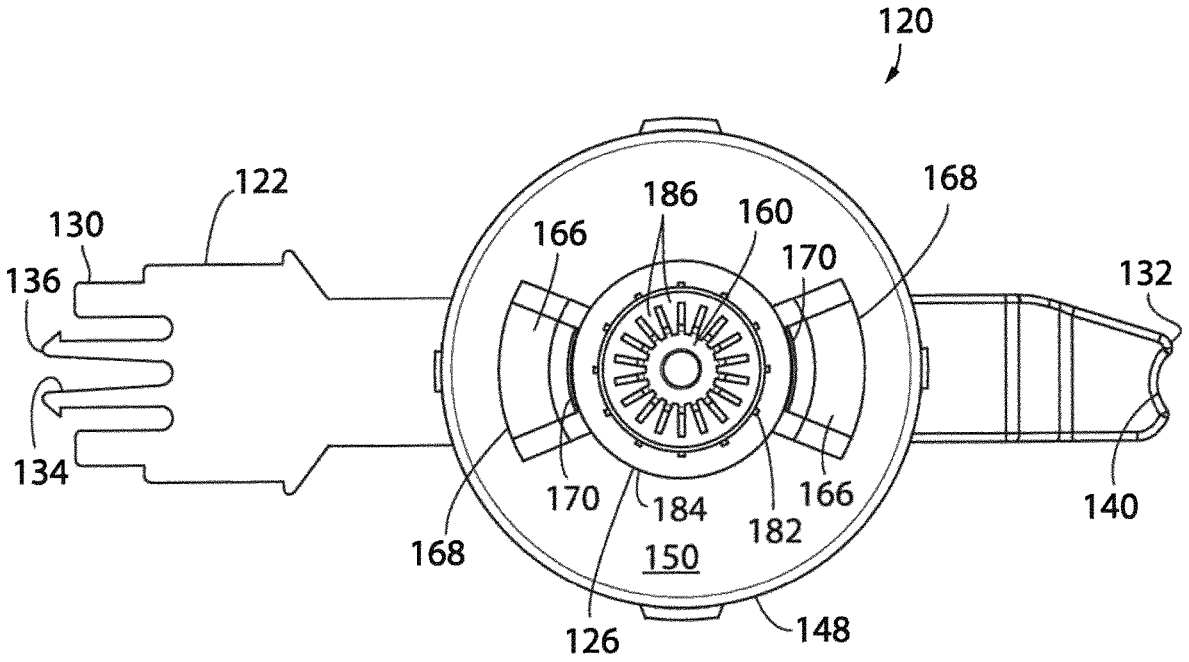
FIG. 10 is a roll facing side elevation view of the assembled lockout system shown in FIG. 9.
Figure 11:
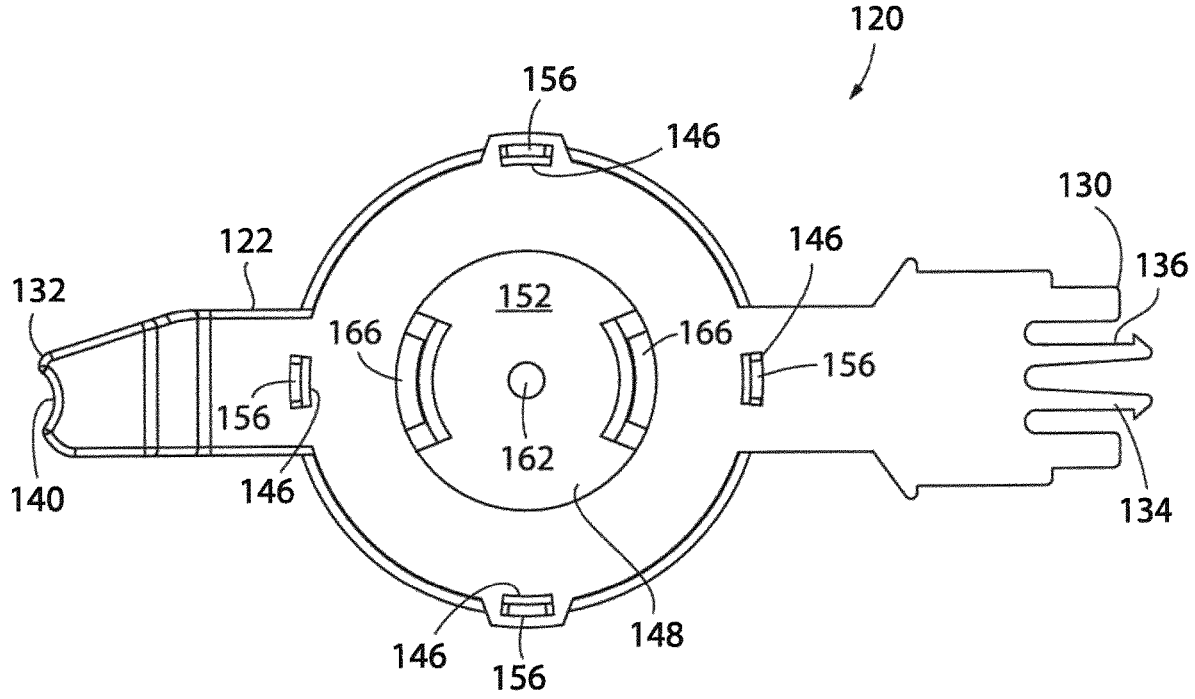
FIG. 11 is a laterally outboard side facing elevation view of the assembled lockout system shown in FIG. 9.
Figure 12:
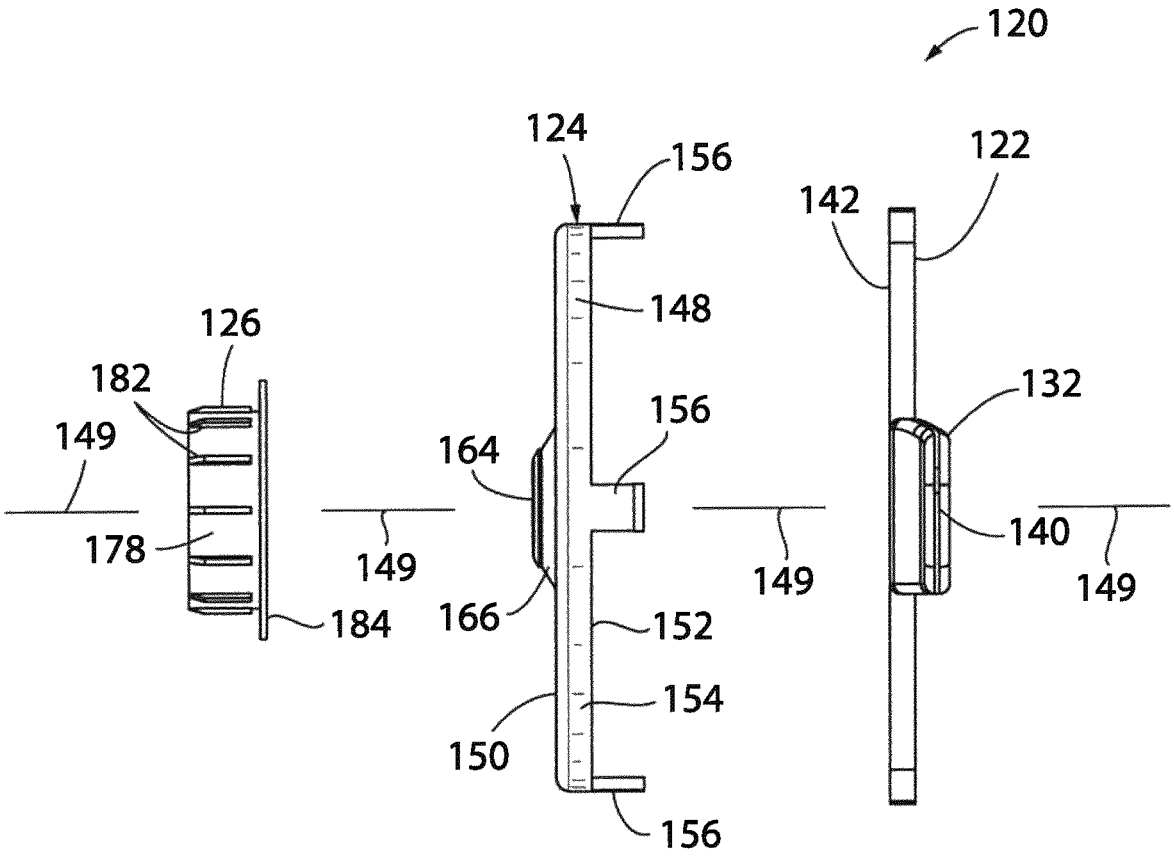
FIG. 12 is a front side exploded elevation view of the lockout system shown in FIG. 9.
Figure 13:
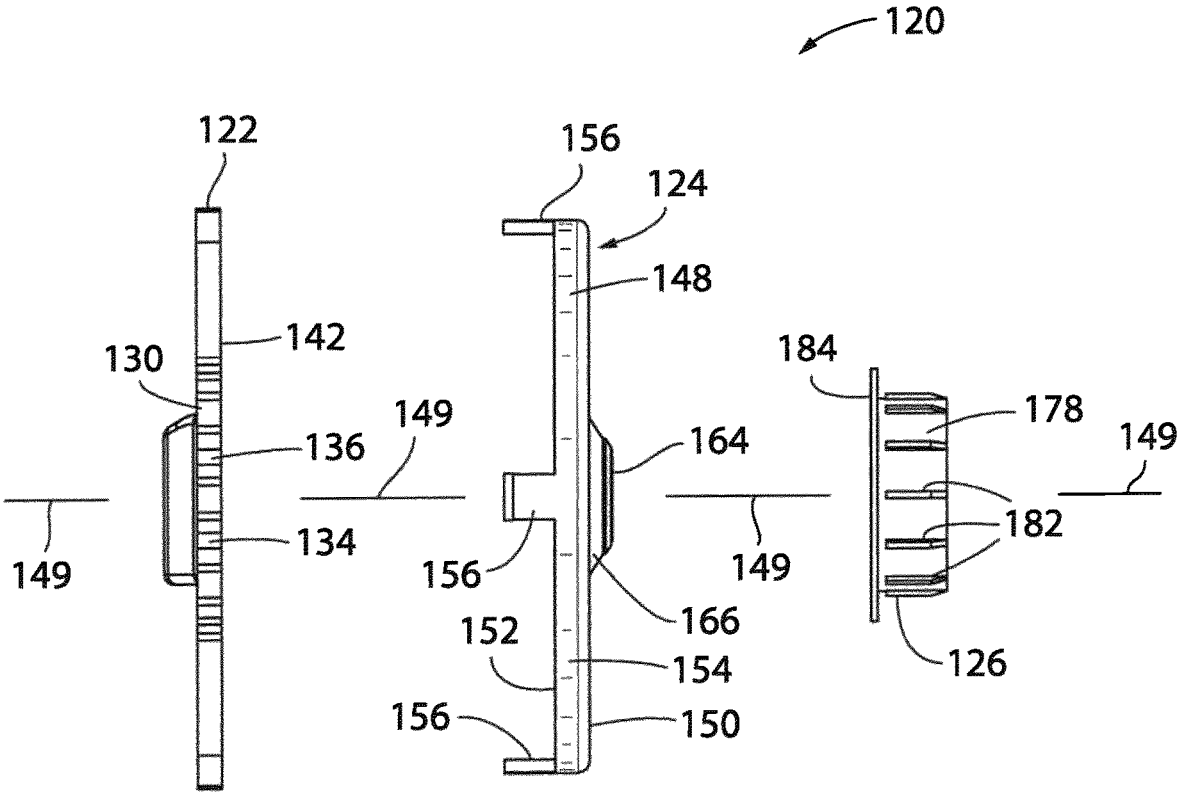
FIG. 13 is a rear side exploded elevation view of the lockout system shown in FIG. 9.
Figure 14:
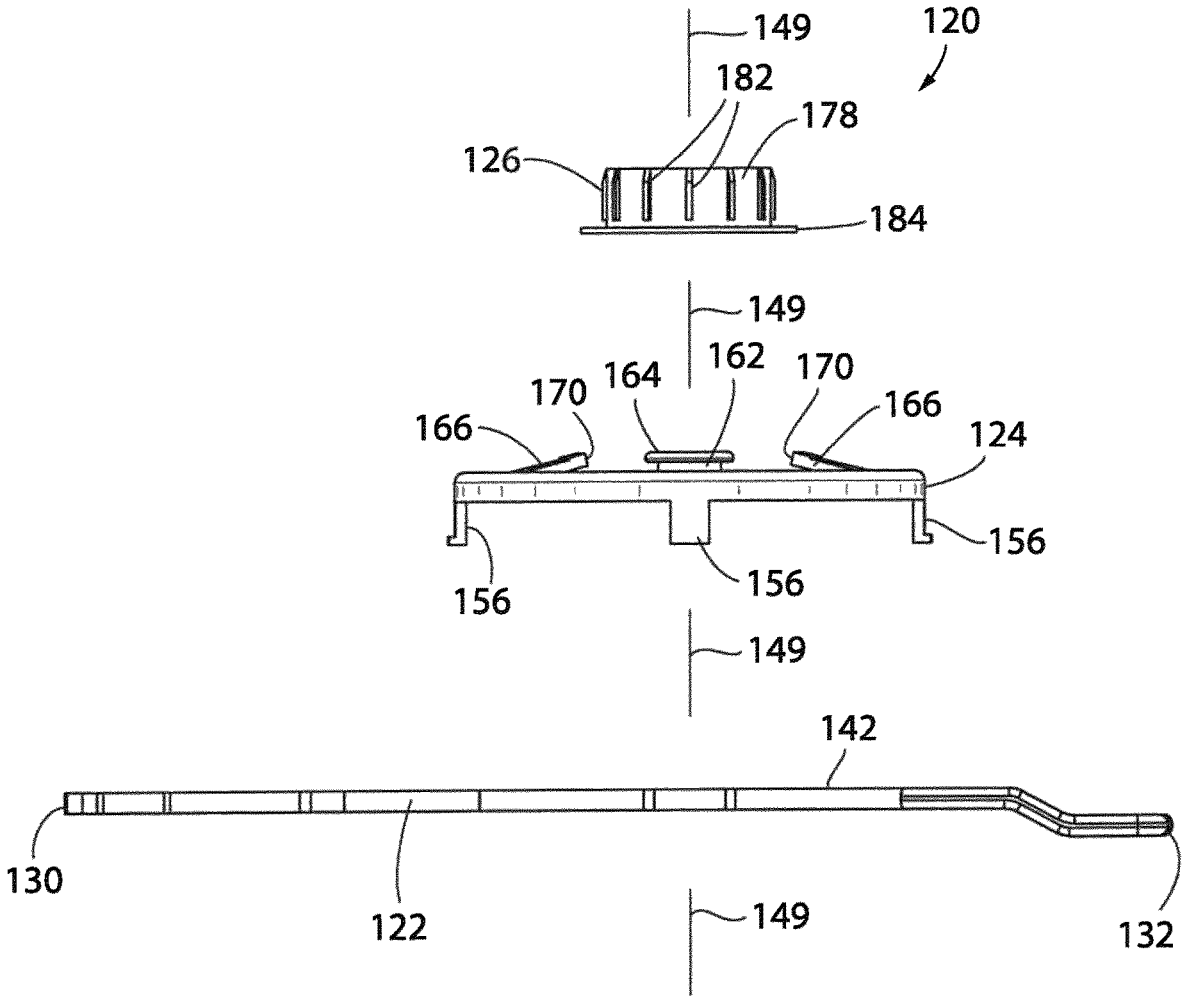
FIG. 14 is a top plan exploded view of the lockout system shown in FIG. 9.
Figure 15:
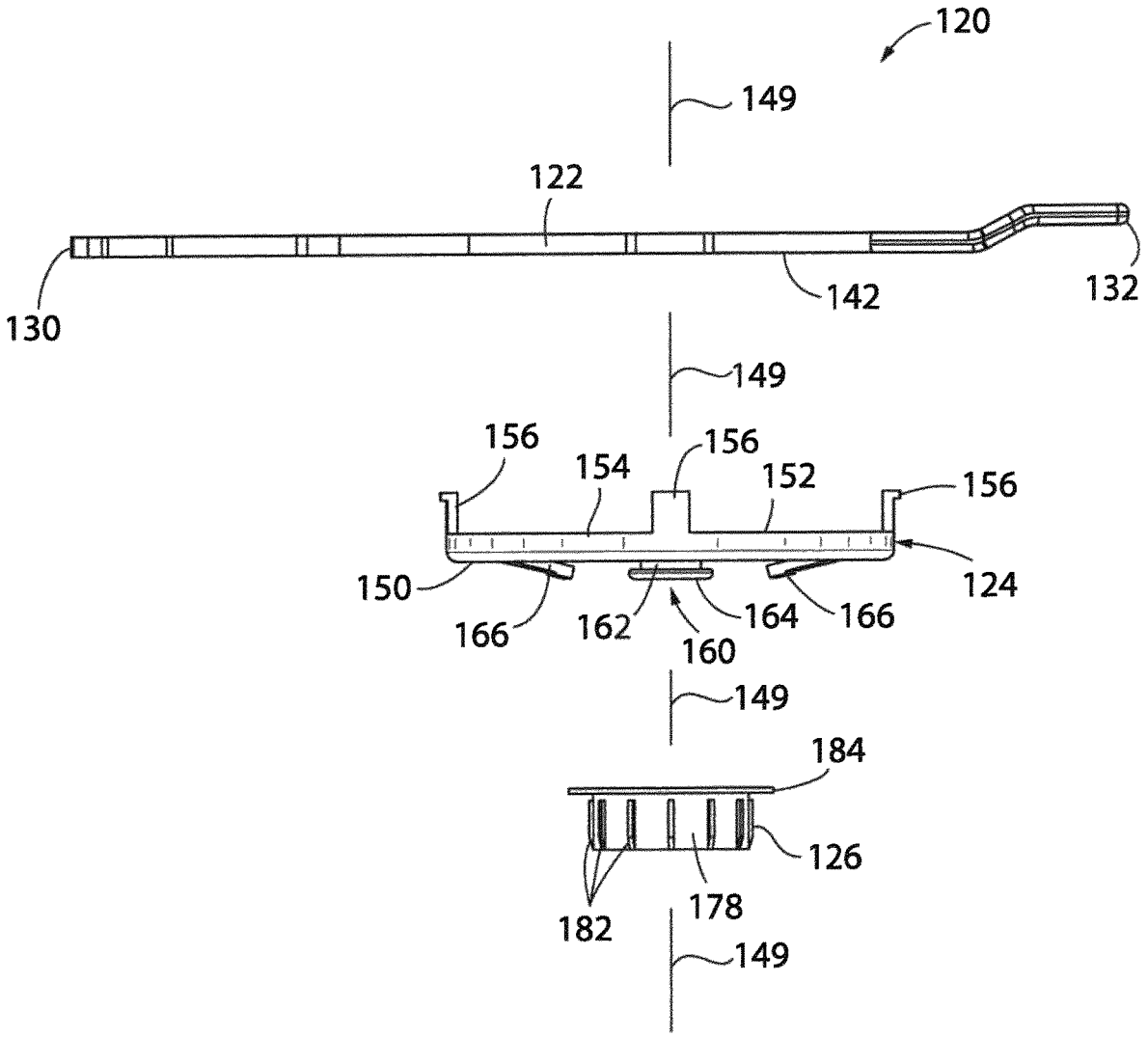
FIG. 15 is a bottom plan exploded view of the lockout system shown in FIG. 9.
Figure 16:
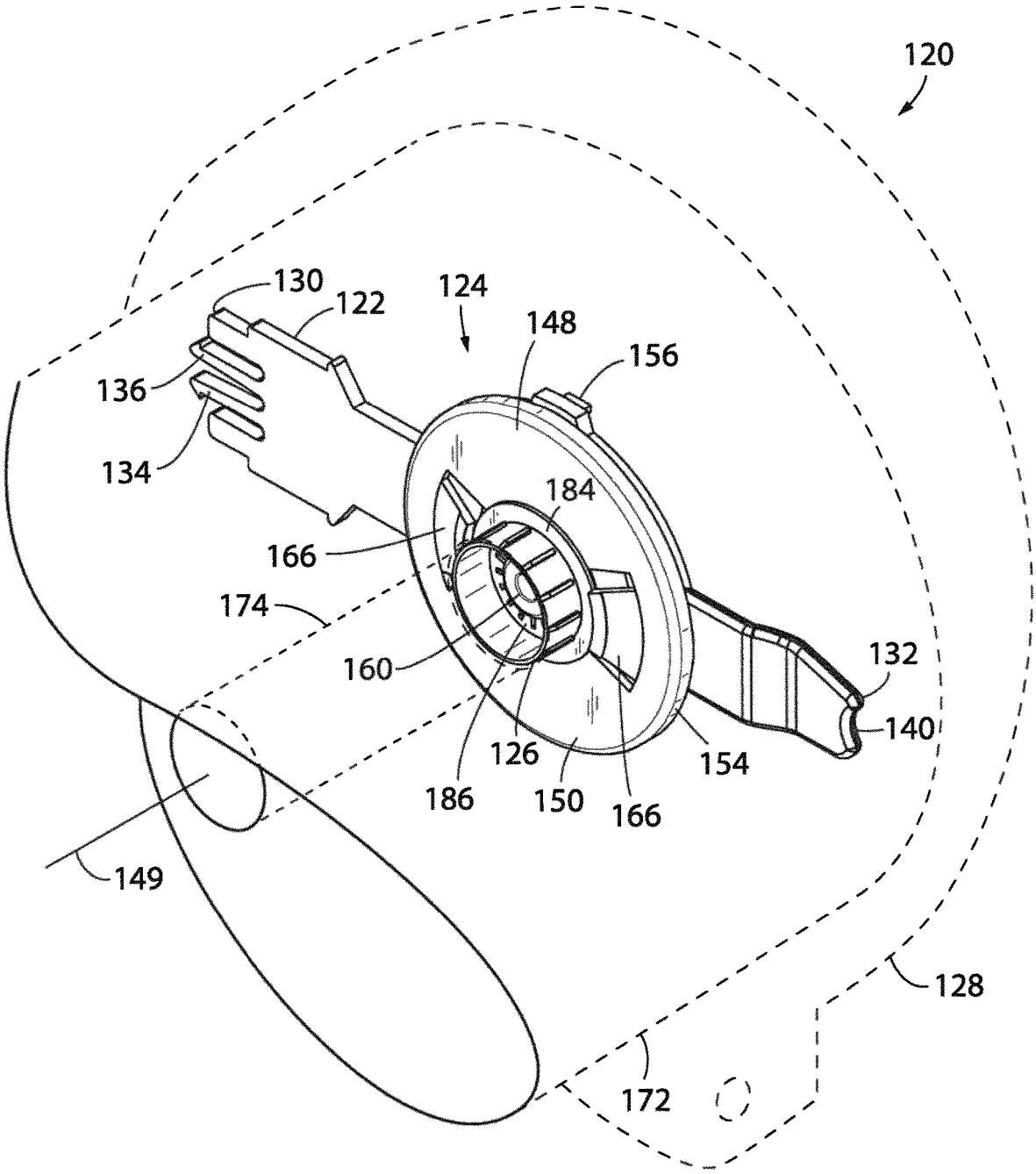
FIG. 16 is a front perspective view of the assembled lockout system shown in FIG. 9 with a phantom roll of authorized web material associated therewith.

Turning now to FIGS. 9-18, and initially FIG. 9, a roll lockout system 120 according to another embodiment of the invention is shown and will be described in further detail below. Roll lockout system 120 includes a roll support arm 122, an adapter 124 and a core insert 126 that extend along a longitudinal axis 149 that is coincident with the longitudinal axis of an authorized roll of web material associated therewith when the same is used to load a dispenser assembly. The roll support arm 122 of the roll lockout system 120 is generally similar to the structure of the roll support arm 22 as described above with respect to roll lockout system 20. Accordingly, the roll support arm 122 and parts thereof are identified by like reference number, which have been increased by a value of "100." That is to say, that the roll support arm 122 is configured to extend from a rear wall and into a roll supporting cavity of a rolled material dispenser assembly 128, as shown in FIG. 16. Like roll support arm 22, roll support arm 122 is constructed to snap-fittingly cooperate with the enclosure of dispenser assembly 128 and support one of the respective opposing ends of a roll of web material disposed therein.

Figure 17:
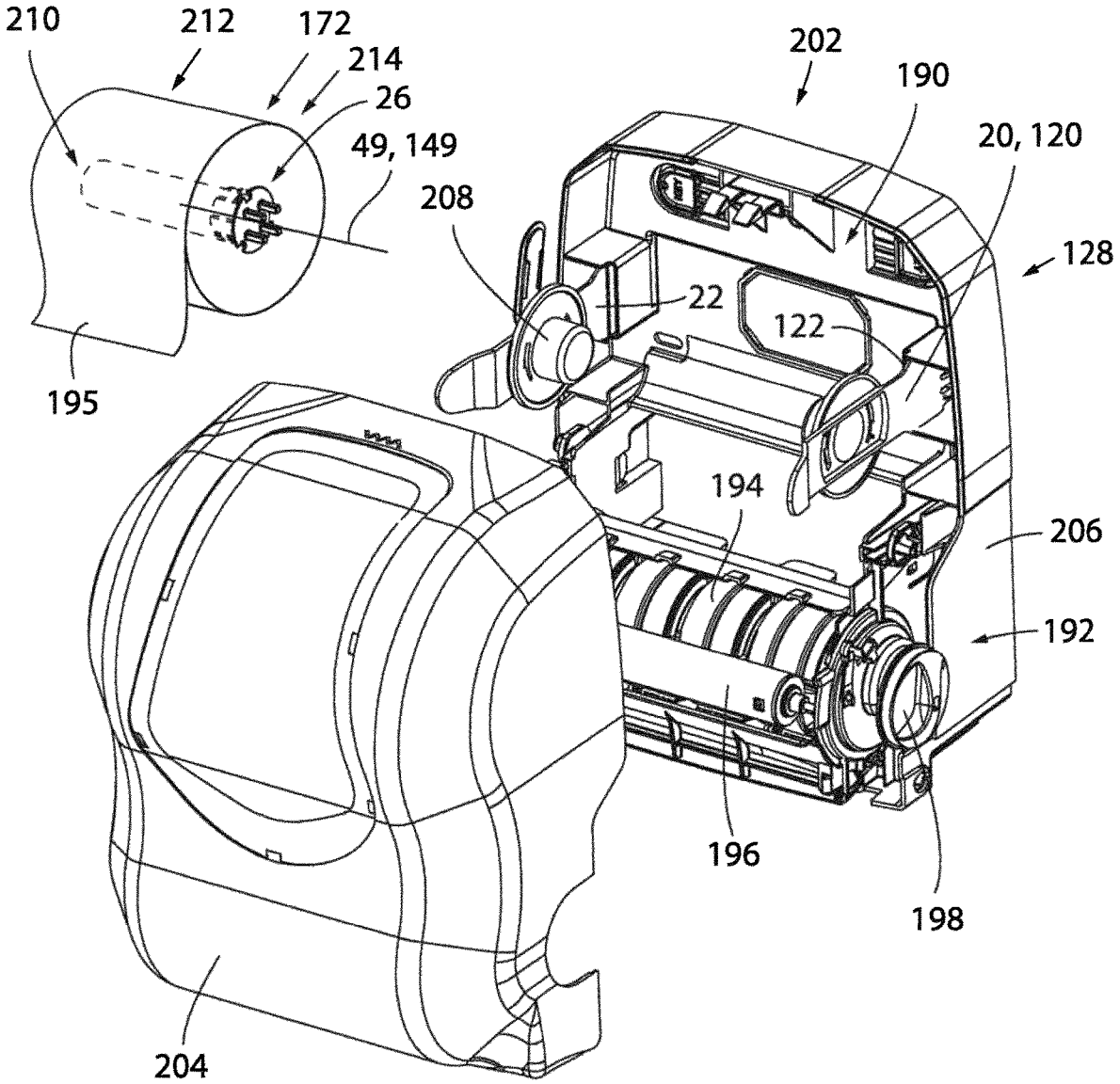
FIG. 17 is a perspective partially exploded view of a dispenser assembly equipped with the rolled material lock out system shown in FIGS. 1-8 and a roll of authorized web material associated therewith.

The roll support arm 122 extends along a length from a first end 130 to an opposing second end 132. The first end 130 of the roll support arm 122 includes a first and second resilient catch arm 134, 136, each of which contain opposing barbs 138 configured to releasably engage a receiving slot in the dispenser assembly 128 in a snap fit configuration. The opposing second end 132 of the roll support arm 122 has an optional arcuate depression that is configured to allow a user to deflect support arm 122 in an outboard or outward lateral or axial direction relative to a roll of web material, or a core of a previously dispensed roll of web material, to facilitate convenient and/or singled handed reloading operation of the dispenser assembly with a subsequent authorized roll of web material as disclosed further below. It is also appreciated that second end 132 of roll support arm 122 could be constructed to slideably cooperate with an interior facing surface of a cover of dispenser assembly as disclosed above with respect to lockout system 20 to allow the weight of the roll of web material carried by support arm 122 to be distributed over both ends 130, 132 of the roll support arm 122 rather than in a cantilevered orientation as shown in FIG. 17 and as disclosed further below. It is further appreciated that support arms 22, 122 are interchangeable relative to one another and interchangeable relative to the opposing ends of a roll of web material and dispenser assembly 28 as disclosed further below.

Like support arm 22, support arm 122 includes an adapter receiving surface or area 142 that is disposed along a portion of the length of the roll support arm 122 between the first and second ends 130, 132 thereof. As shown in FIG. 9, the adapter receiving area 142 in one embodiment of the present invention is generally circular having a hollow center or void 144 therein. However, it should be understood that the present invention is not so limited and that other configurations of the adapter receiving area 142 are considered within the scope of the present invention. Still referring to FIG. 9, the adapter receiving area 142 includes a plurality of receiving slots 146 that are annularly disposed generally proximate the perimeter of the adapter receiving area 142 for receiving and mating to the adapter 124 as described in further detail below.

The adapter 124 of the roll lockout system 120, differs from that of the roll lockout system 20, in that the adapter 124 is formed of a single integral component, e.g. disc 148. The disc 148 of the adapter 124 comprises a width extending between an axially inboard or roll facing, or a front surface 150 and an axial outboard or away from a roll facing or a rear surface 152. The outer perimeter of the disc 148 is defined by an annular outer wall 154 that extends rearwardly towards the adapter receiving area 142 of the roll support arm 122. A plurality of resilient catch fingers 156 are annularly disposed about an axial outboard or a rear edge of the outer wall 154 and are configured to deflect while passing through and be frictionally retained within the receiving slots 146 that are annularly disposed about the perimeter of the adapter receiving area 142. That is to say that after passing the resilient catch fingers 156 through the slots 146, a radially outwardly directed barb 158 on the end of one or more of fingers 156 prevents inadvertent separation or disengagement of the disc 148 of the adapter 124 from the adapter receiving area 142 of roll support arm 122. In this configuration the disc 148 is releasably affixed to the front surface of the adapter receiving area 142 of the roll support arm 122 while simultaneously inhibiting rotation of the disc 148 relative thereto.

Still referring to FIG. 9, the disc 148 further comprises a centrally located hub 160 that extends in an axially inboard direction, roll facing direction, or forward direction relative to the roll facing or front surface 150 and generally about the central axis of the disc 148. As shown in FIGS. 14 and 15, the hub 160 comprises a post 162 that extends from the front surface 150 of the disc 148 and has a generally circular retention cap 164, where the cap 164 has a radius greater than that of the post 162, formed at the distal free end of the hub 160. That is, the configuration of the roll facing or front surface 150 of disc 148, post 162, and cap 164 defines a substantially annular groove formed between the disc facing side of cap 164 and roll facing or front surface 150 of disc 148 and the radially outward directed surface of post 162. As described further below, the hub 160 is configured to engage the core insert 126 thereon such that core insert 126, and the authorized roll of web material associated therewith, is supported by disc 148 and rotatable relative thereto. Like disc 50, hub 160 of disc 148 extends in the axial direction a substantially deminimis distance such that hub 160 of disc 148 is insufficient to receive and securely retain a conventional roll of web material in the absence of a corresponding core insert 126 being associated therewith.

Referring briefly back to FIG. 9, the disc 148 may further comprise one or more optional deflectable braking tabs 166 disposed within the disc 148 between the hub 160 and the outer wall 154. The braking tabs 166 generally comprise a first end 168 affixed to the disc 148 and an opposing second end 170 that is independent of the disc 148 such that the second end 170 may flex or deflect upon the application of an axially directed force being applied thereon. As further shown in FIG. 9, the second end 170 of each braking tab 166 extends forward of the roll facing or front surface 150 of the disc 148. In this configuration, the second end 170 of each braking tab 166 may frictionally engage the lateral edge or respective axial end of a discrete roll of web material 172 during use of the roll lockout system 120 and exert a drag or braking force on the movement of the authorized roll of web material associated with the dispenser assembly and to thereby reduce incidence of free spinning of the roll of web material 172. As disclosed further below with respect to FIG. 17, such considerations maintain a taught configuration of the portion of the authorized web material that extends between the roll and the roller assembly associated with the dispense activity thereby providing a repeatable dispense activity for each actuation of the dispenser assembly throughout consumption of each discrete authorized roll of web material associated with the dispenser assembly.

Like core insert 26, core insert 126 is configured to be disposed within the hollow or a core 174 of each discrete roll of web material 172, as shown briefly in FIG. 16, that is authorized to be dispensed by a dispenser assembly equipped with lockout system 120. Returning now to FIG. 9, the core insert 126 according to the roll lockout system 120 includes an annular wall 176 extending between a roll facing or front edge 178 and an outboard facing or rear edge 180. A plurality of retention barbs 182 extend in an outward radial direction from the radially outer surface of the annular wall 176 and are configured to frictionally engage the core 174 of the authorized roll of web material 172 and increase retention of the core insert 126 within the core 174 or hollow center portion of the roll of web material. To further improve proper positioning of the core insert 126 within the roll core 174, an outer flange 184 extends annularly outward about the rear edge 180 of the wall 176. In use, the outer flange 184 abuts the radially extending respective end portion of the roll of web material 172 and prevents the core insert 126 from being placed too deep within the core 174 to accommodate operable supporting engagement of the core insert 126 with disc 148 as disclosed further below.

A plurality of projections or hub retention fingers 186 are disposed proximate flange 184 at the laterally outboard or rear edge 180 of the wall 176 of core insert 126. Each of the hub retention fingers 186 extends in generally radially inward projecting direction and are provided in a cantilevered orientation such that a distal or free end of each of the respective retention fingers 186 terminates short of a rotational axis or axis 149 of core insert 126. The retention fingers 186 are slightly flexible or deflectable relative to flange 184 in the axial direction 149 and allow the core insert 126, during use, to be pressed axially outboard or in an axial direction away from the roll of web material associated therewith until, as seen in FIG. 16, the outer flange 184 abuts the roll facing or front surface 150 of the disc 148, and the hub retention fingers 186 deflect over the cap 164 of the hub 160, and are retained in the groove defined between the cap 164, the roll facing or front surface 150 of the disc 148, and the radially outward facing surface of post 162.

It should be appreciated that unlike projections or posts 82 of insert 26, projections or retention fingers 186 extend in a generally radial direction rather than axial direction. It should be further appreciated that fingers 186 are oriented to achieve a frustoconical, of having the shape of a fustrum of a cone, shape when the fingers 186 are engaged with hub 160 of adapter 124 such that fingers 186 can achieve an orientation of deflective over the outermost radial diameter of hub 160 and engage groove defined by post 162 of hub 160 during engagement and removal of insert 126 therewith. It should be further appreciated the plurality of projections posts, or fingers 82, 186 defined by each of inserts 26, 126 are oriented radially inboard relative to an outermost radial dimension of each of respective inserts 26, 126 and are oriented to cooperate with a radially interior location of the corresponding adapter 24, 124. Such considerations provide a compact engagement interface between the respective insert 26, 126 and the corresponding adapter 24, 124 such that a respective dispenser can be quickly and conveniently configured for operation with a desired one of lockout systems 20, 120.

Accordingly, only rolls of web material 172 having a core insert 126 that includes retention fingers 186 that are properly sized and spaced relative to one another to accommodate engaging the cap 164 of the hub 160 therein will be properly received by the dispenser or dispenser assembly 128 comprising a roll lockout system 120 according to the second non-limiting embodiment of the present invention and in a manner that will facilitate incremental dispensing of the authorized roll of web material. Furthermore, in addition to providing mating between the retention fingers 186 and the hub 160, the fingers 186 and hub 160 also provide the rotational physical support for core insert 126 and its surrounding roll of web material 172 to be releasably retained by the disc 148.

As shown in FIG. 17, during implementation, or upon depletion of the roll of web material 172, the cavity 190 of dispenser assembly 128 may be exposed to allow the user access thereto. Dispenser assembly 128 includes a feed mechanism 192 that is constructed to cooperate with a free end 195 of roll of web material 172 to effectuate each dispense activity. Feed mechanism 192 includes a number of rollers 194, 196 that are constructed to effectuate the dispense activity and thereby unwind the roll of web material 172 during each dispense action. Dispenser assembly 128 includes a handle 198 that is operational to effectuate manual operation of one or more of rollers 194, 196 to effectuate the dispense activity. Although configured to accommodate manual dispensing operation, it is appreciated that dispenser assembly 128 could be provided to operate in an automatic or touchless manner via the inclusion of various proximity sensors and drive systems configured to actuation operation of rollers 194, 196 in response to the proximity of a user, or user's hand, relative to a throat or dispense opening 200 of dispenser assembly 128 when in the ready for use configuration or with other manual actuation assemblies such as manually operable lever arms, push paddles, or the like.

Still referring to FIG. 17, dispenser assembly 128 includes a housing 202 that is generally defined by a cover 204 that movably or pivotably cooperates with a base 206 such that opening of housing 202 of dispenser assembly 128 exposes cavity 190 associated with accepting an authorized roll of web material 172. As shown in FIG. 17, dispenser assembly 128 preferably includes at least two support arms 22, 122 that are disposed on generally opposite lateral sides of cavity 190. One of support arms 22, 122 includes a bobbin or a boss 208 that is shaped to cooperate with a bore or hollow cavity 210 of a coreless roll of web material 172 of indiscriminate source. It is appreciated that the axially oriented cavity 210 of the discrete rolls of web material can be defined by a cigarette of the roll of material, a cardboard or other rigid material core tube upon which the web paper material is wound, or other methodologies commonly employed in the web paper roll material forming processes to create the hollow bore associated with the roll of web material. Regardless of the methodology employed, boss 208 is shaped to rotationally support a roll of web material from a majority of sources of rolled web material. The other of support arms 22, 122 of dispenser assembly 128 is provided with a respective one of material lockout systems 20, 120.

In the embodiment shown in FIG. 17, it can be appreciated that support arm 22, 122 includes lockout system 20 as authorized roll of web material 172 includes core insert 26. It should be appreciated that dispenser assembly 128 can be readily configured to operate with either of lockout systems 20, 120 via the replacement of the respective lockout enabled support arm 22, 122 and/or engagement of the other of adapters 24, 124 with a discrete respective support arm 22, 122. It is further appreciated that, although dispenser assembly 128 is shown as being equipped with one lockout system 20, 120 associated with a respective one of lateral or axial ends 212, 214 of authorized roll of web material 172, dispenser assembly 128 could be configured to include a pair of lockout systems 20, a pair of lockout systems 120, or a respective one of each of lockout systems 20, 120 being associated with a respective one of support arms 22, 122.

It is further appreciated that one of lockout systems 20, 120 can be configured to cooperate with only one of the respective axial ends 212, 214 of authorized rolls of web material 172 and in a manner wherein the "overhand" (as shown in FIG. 17) or "underhand" unwinding orientation of the authorized roll of web material relative to dispenser assembly 128 creates a desired presentation of the free end 195 of the authorized roll of web material 172 at feed mechanism 192 to effectuate the desired continual sequential dispensing of the web material. After an authorized roll of web material 172 has been fully dispensed or otherwise depleted, housing 202 can be opened and the remaining disposable insert 26, 126, absent its respective supply of rolled web material 172, may be removed from the respective corresponding adapter 24, 124 and subsequently discarded and/or recycled, and a new authorized roll of web material 172 with a respective core insert 26, 126 orientation and construction in accordance with the respective one or more of support arms 22, 122 to provide the operative cooperation with the respective adapter 24, 124 can be associated with underlying dispenser assembly 128 for continued use thereof. Whether provided with one or more of, or mixed relations of, roll lockout systems 20, 120, dispenser assembly 128 can be expeditiously configured to allow operability of the dispenser assembly 128 to dispense only material from rolls of web material that have been previously designated as acceptable for use with the respective dispenser assembly 128.

Figure 18:
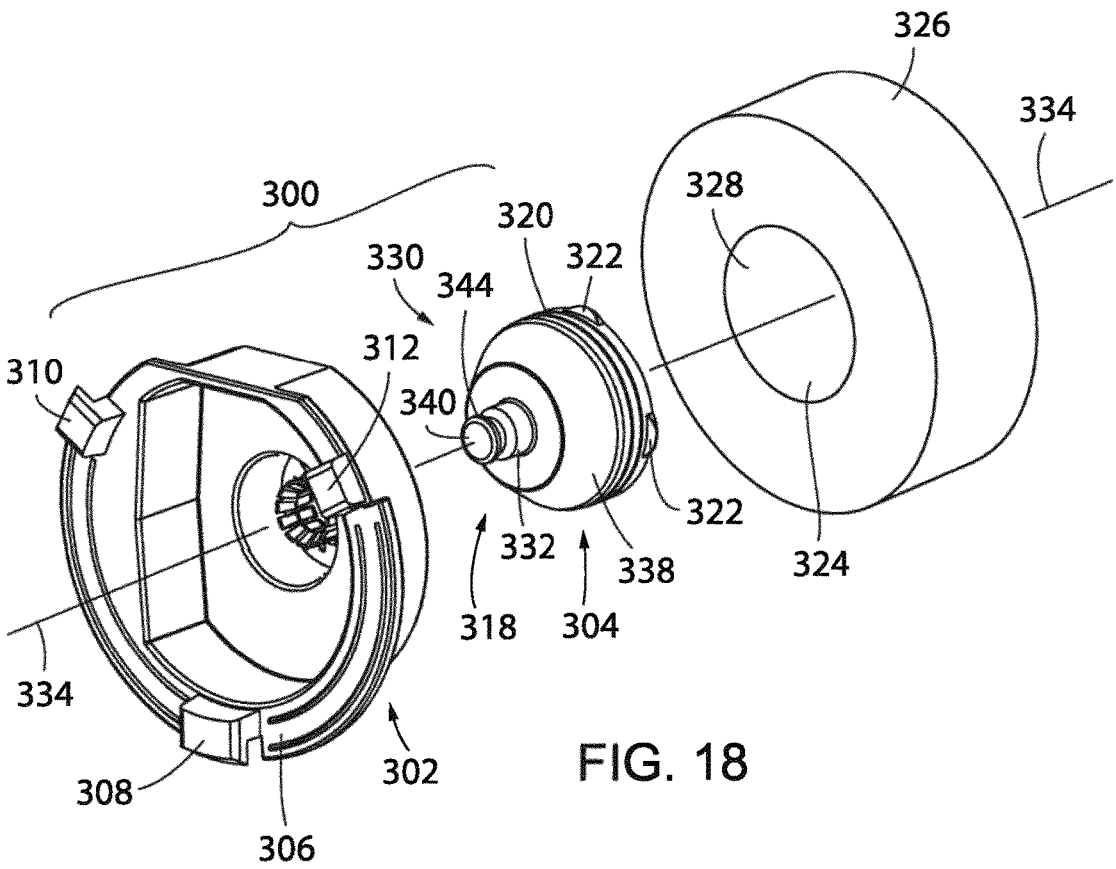
FIG. 18 is a perspective exploded view of a web material dispenser lockout system according to another embodiment of the present application with a roll of web material exploded therefrom.

FIGS. 18-23 show various views of a roll lockout assembly or lockout system 300 according to another embodiment of the present invention. Like lockout systems 20, 120, lockout system 300 includes an adapter or a hub 302 that is constructed to removably cooperate with an insert 304 having a construction suitable to cooperate with hub 302. Referring to FIG. 18, hub 302 includes a first side 306 that is constructed to cooperate with a dispenser housing such as a roll support arm such as roll support arms 22, 122. Dispenser facing side 306 of hub 302 includes one or more tabs 308, 310, 312 that are oriented generally about the circumference of side 306 and constructed the snap-fittingly cooperate with a corresponding roll support arm.

A roll facing side 314 of hub 302 includes an engagement interface 316 that is constructed to removably cooperate with an engagement interface 318 associated with insert 304. Insert 304 includes an outer radial surface 320 having one or more barbs 322 that are constructed to engage a bore 324 defined by a roll 326 of web material. Bore 324 may be defined by the core of a roll of web material or defined by the inner wraps of what is commonly considered a coreless roll of web material. Whether engaged with a core or coreless bore associated with the roll of web material, barbs 322 are constructed to cooperate with the radially interior facing surface 328 of the roll 326 to provide secure interaction and support of roll 326 via insert 304.

Figure 20:
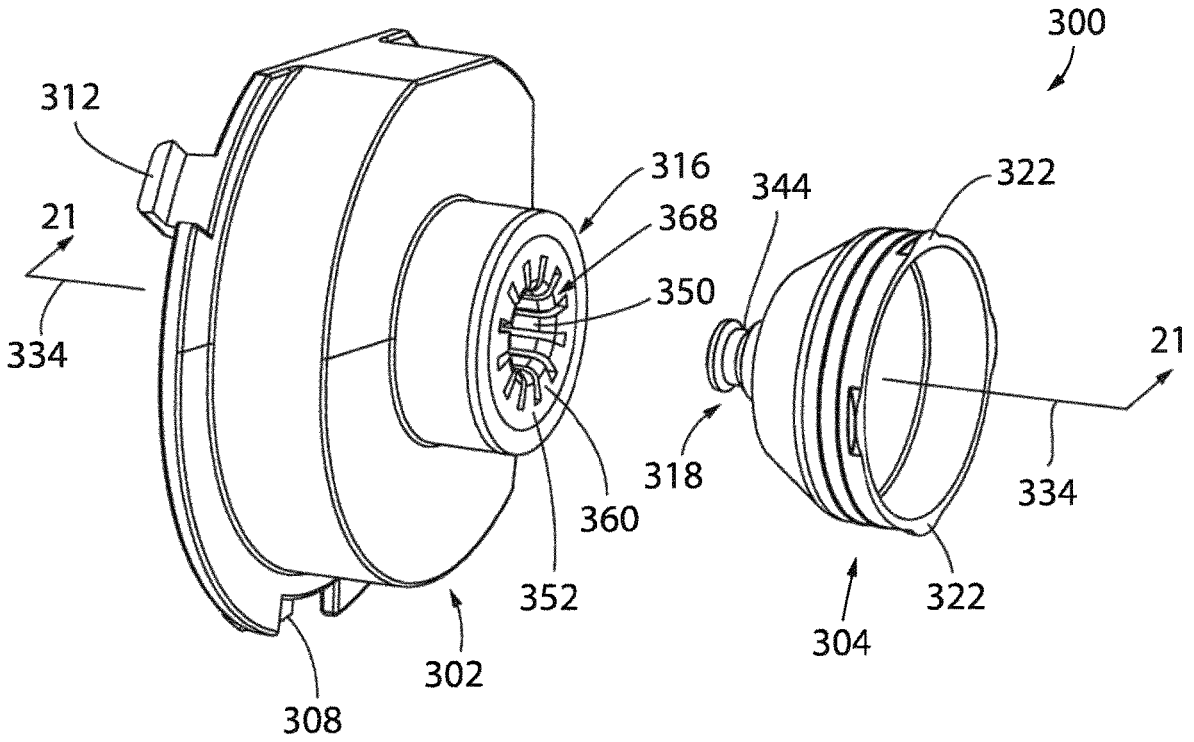
FIG. 20 is a perspective view of the lockout system shown in FIG. 18.
Figure 21:
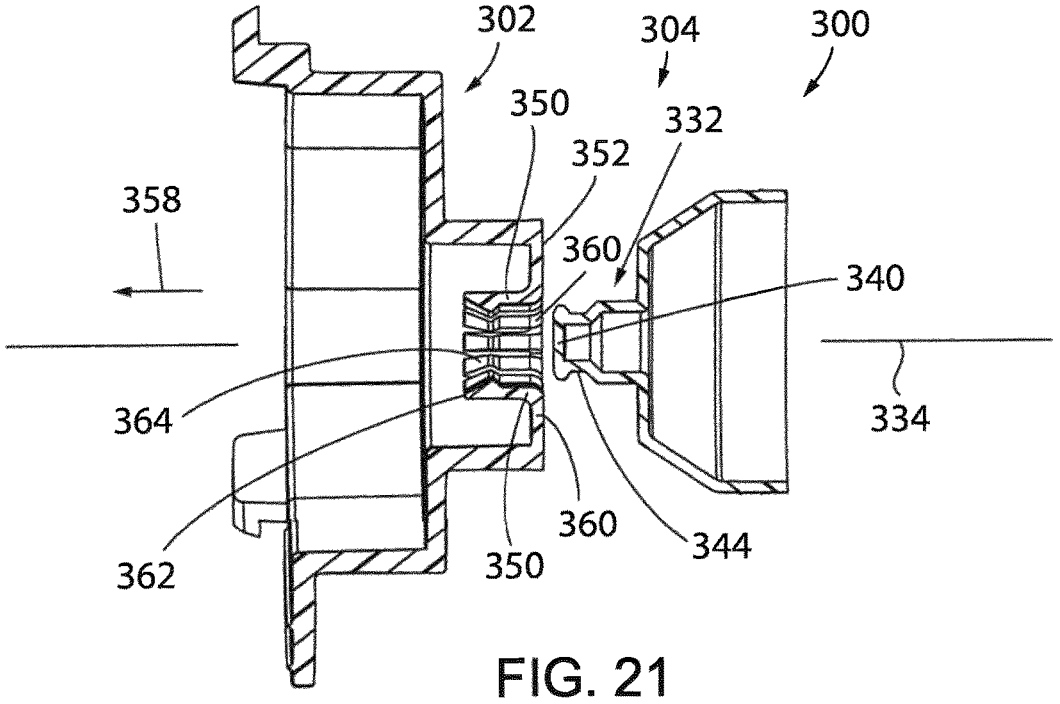
FIG. 21 is a cross section view of the lockout system shown in FIG. 18 taken along line 21-21.

A projection 332 is formed at the hub facing end 330 of insert 304 and which extends in a generally axial direction along axis 334 relative to body 338 of insert 304. An annular groove 344 extends about a circumference of projection 332 proximate a distal end 340 thereof. Projection 332, distal end 340, and groove 344 collectively define engagement interface 318 of insert 304 and which removably cooperate with engagement interface 316 defined by hub 302. As shown in FIGS. 20 and 21, engagement interface 316 of hub 302 includes a plurality of retainers for fingers 350 that extend from an insert facing end 352 of hub 302 along axis 334 and in a direction generally away from insert facing end 352 of hub 302.

As shown in FIG. 21, each retainer or finger 350 extends in a generally inward axial direction, indicated by arrow 358, relative to end 352 of hub 302. Each finger 350 is formed in a generally cantilevered manner or forms a cantilever generally defined by a support end 360 proximate end 352 and a free end 362 that is generally offset therefrom in a direction away from insert 304. A projection 364 extends in a generally inward radial direction from the free end 362 of each finger 350. During association of insert 304 relative to hub 302, hub facing distal end 340 of projection 332 of insert 304 slidably cooperates with a cavity 368 that extends radially inboard relative to the plurality of fingers 350 and that is laterally or axially outboard relative to the discrete projections 364 associated with the free ends 362 of each discrete finger 350. Such considerations allow insert 304 to axially align itself, and the roll of web material 326 associated therewith, relative to the axis of rotation 334 of the insert 304 and the axis of axial translation between insert 304 and hub 302.

Figure 22:
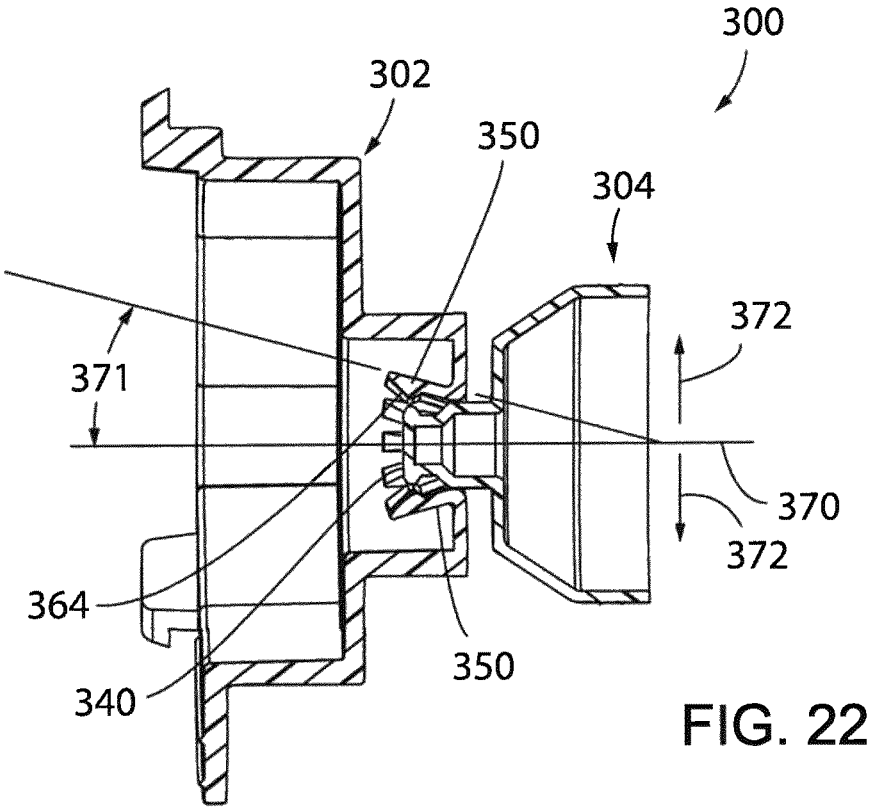
FIG. 22 is a view similar to FIG. 21 and shows the insert associated with the hub a distance sufficient to effectuate displacement of restraint members.
Figure 23:
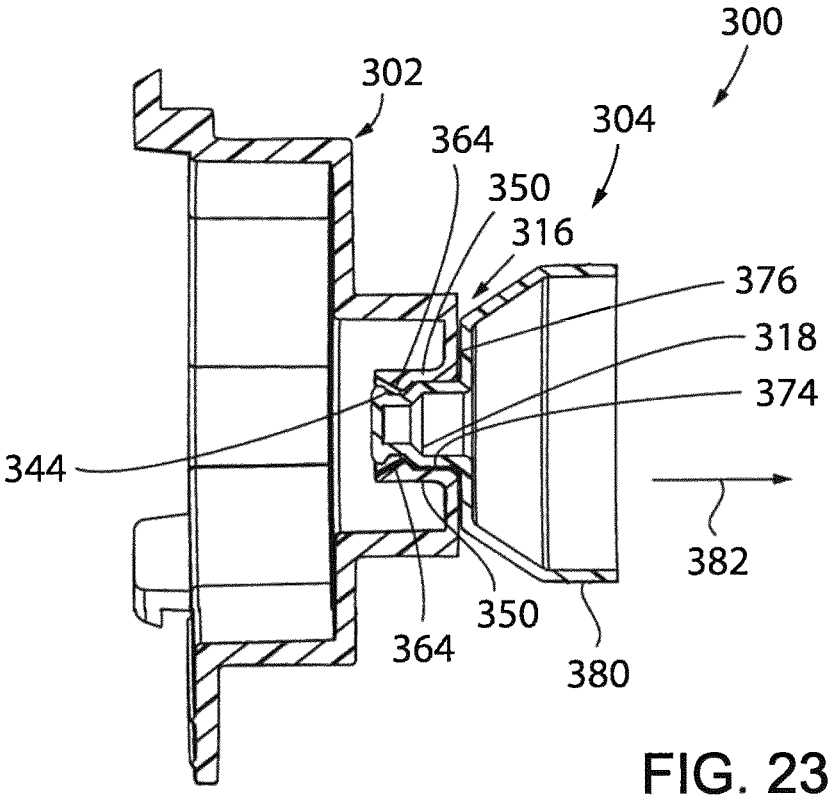
FIG. 23 is a view similar to FIGS. 22 and 23 and shows the insert engaged with the hub such that the restraint members inhibit axial translation between the insert and the hub but accommodate rotational interaction therebetween.

Referring to FIGS. 22 and 23, each retainer or finger 350 deflects in a substantially radially outward direction, indicated by angle 371, when the distal end 340 of insert 304 impinges upon projections 364 and during inward relative axial translation, indicated by arrow 370, of insert 304 relative to hub 302. The generally outward radial deflection, indicated by arrows 372, associated with each finger 350 allows insert 304 to axial translate in direction 370 until insert 304 achieves a position relative to hub 302 wherein projections 364 associated with discrete fingers 350 seat in the void defined by channel 344 associated with insert 304. The radial circumferential cooperation of fingers 350 with engagement interface 318 of insert 304 provides a robust rotational connection between insert 304 and hub 302 yet provides a connection methodology that can be readily manually overcome to effectuate removal of an insert 304 previously associated with a recently consumed roll of web material upon consumption of the entirety of the roll or when replacement of the same is desired as a manner of convenience to service personnel.

When projections 364 associated with fingers 350 are engaged with channel 344 of insert 304, a radially oriented bearing surface 374 extends in a circumferential manner between the radially inward facing surfaces of fingers 350 and the radially outward directed surfaces associated with engagement interface 318. A second bearing surface or a thrust bearing surface or engagement 376 is defined by a generally radially oriented, but axially slidable rotational cooperation, between those portions of insert 304 that generally abut the radially outward directed portions of engagement interface 316 defined by hub 302. Removal of an insert 304 associated with a recently consumed roll of web material is conveniently accommodated by gripping of the sidewall 380 of insert 304 and subjecting the insert 304 to an generally axial load, indicated by arrow 382, to effectuate a generally outward radial deflection of fingers 350 and thereby the disengagement of projections 364 of discrete fingers 350 from channel 344 defined by insert 304.

Although FIGS. 20-23 show a radial orientation of fingers 350 that includes a plurality of fingers that extend in a substantially uniform manner about the entire circumference associated with the interface between insert 304 and hub 302, it should be appreciated that other configurations are envisioned. That is, it is appreciated that fingers 350 may be provided in a configuration wherein each finger is wider than then width of the fingers shown in FIG. 20. It is further appreciated that fingers 350 may be provided in any number of discrete or independently deflectable retainers or fingers. For instance, fingers 350 may be oriented in a manner wherein greater than two and as few as three discrete fingers are provided and spaced radially about the circumference associated with the engagement between hub 302 and insert 304 in a manner that retains the desired rotational cooperation between the hub and insert 302, 304 while maintaining a robust but conveniently manually severable axial association between hub 302 and insert 304 to effectuate the desired removal and replacement of a subsequent roll of web material upon consumption of a roll of web material and/or premature replacement of the same.

Figure 24:
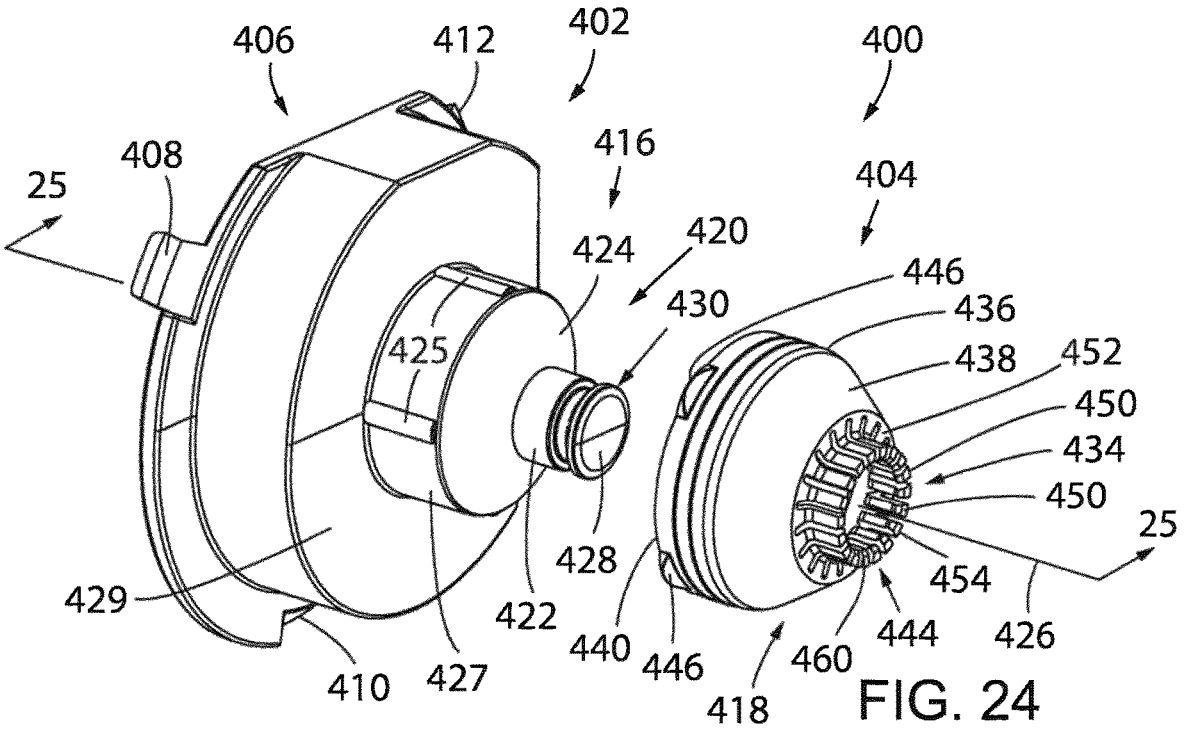
FIG. 24 is a view similar to FIG. 20 and shows a lockout system according to another embodiment of the present invention.
Figure 25:
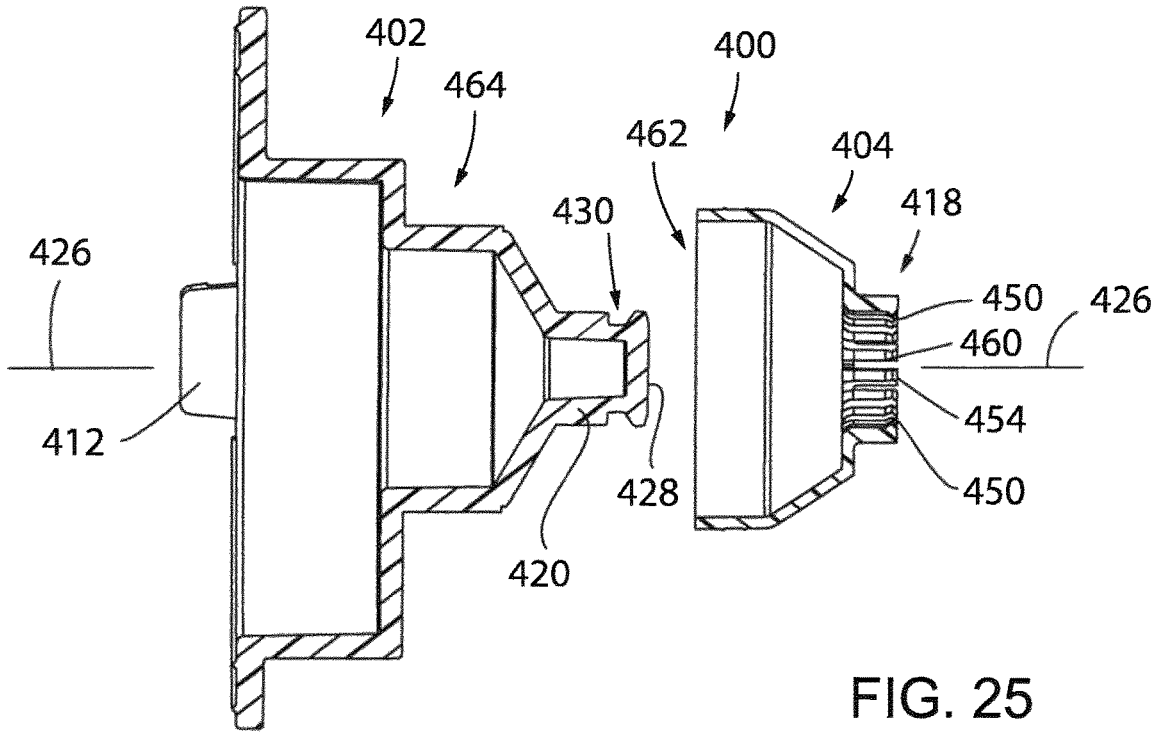
FIG. 25 is a cross section view of the lockout system shown in FIG. 24 taken along line 25-25.

FIGS. 24-29 show a roll lockout assembly or system 400 according to another embodiment of the present invention. It should be appreciated that roll lockout assembly or system 400 has a construction somewhat similar to lockout system 300. Referring to FIGS. 24 and 25, lockout system 400 includes a hub 402 that is constructed to removably cooperate with an insert 404. Hub 402 includes a dispenser facing side 406 having one or more projections 408, 410, 412 that are constructed to tool-lessly and preferably snap-fittingly or otherwise selectively removably cooperate with a roll support arm such as support arms 22, 122 has disclosed above.

Hub 402 includes an engagement interface 416 that is constructed to rotationally support and axially cooperate with an engagement interface 418 associated with insert 404. Engagement interface 416 associated with hub 402 includes a first portion 420 that is generally defined by a post 422 that extends in an axial direction from a barrel portion 424 of hub 402 along an axis of rotation about axis 426 associated with the axis of rotation associated with a roll of web material supported by lockout system 400. Post 422 extends along axial direction of axis 426 between barrel portion 424 and a distal end 428 defined by post 422. Channel 430 is formed proximate distal end 428 of post 422 and constructed a snap-fittingly cooperate with engagement interface 418 as disclosed further below.

Figure 19:
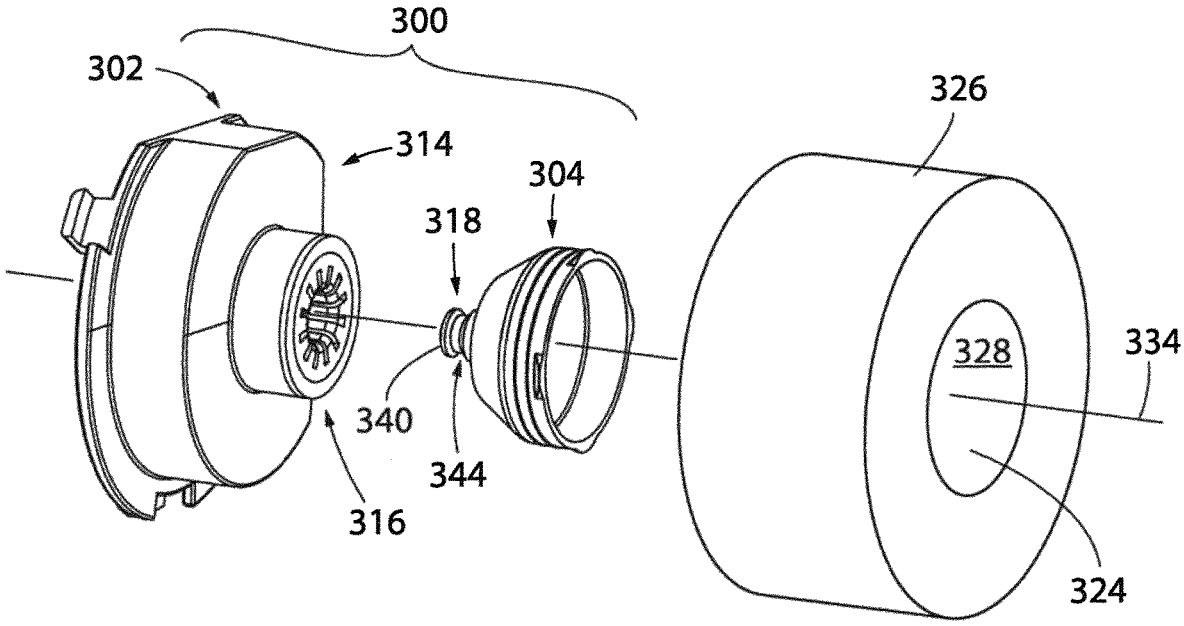
FIG. 19 is another perspective exploded view of the web material dispenser lockout system shown in FIG. 18.

Barrel portion 424 of hub 402 includes an outer radial portion 427 that extends an axial direction along axis 426 from the hub facing end of post 422. A shoulder 429 is defined by hub 402 and includes one or more ribs 425 that extend in axial direction 426 along surface of radial portion 427 and cooperate with the radially inward directed surface of insert 404 when insert 404 is engaged with hub 402. A channel 430 is formed in post 422 proximate distal end 428 and is constructed to axially cooperate with engagement interface 418 of insert 404. Insert 404 includes an outwardly directed radial surface 436 of a body 438 that defines insert 404 between the hub facing end 440 and an opposing end 444 of insert 404. One or more projections 446 extend in a generally outward radial direction relative to surface 436 to secure insert 404 relative to the bore defined by a roll of web material, such as roll 326, as disclosed above and as shown in FIGS. 18 and 19.

Figure 26:
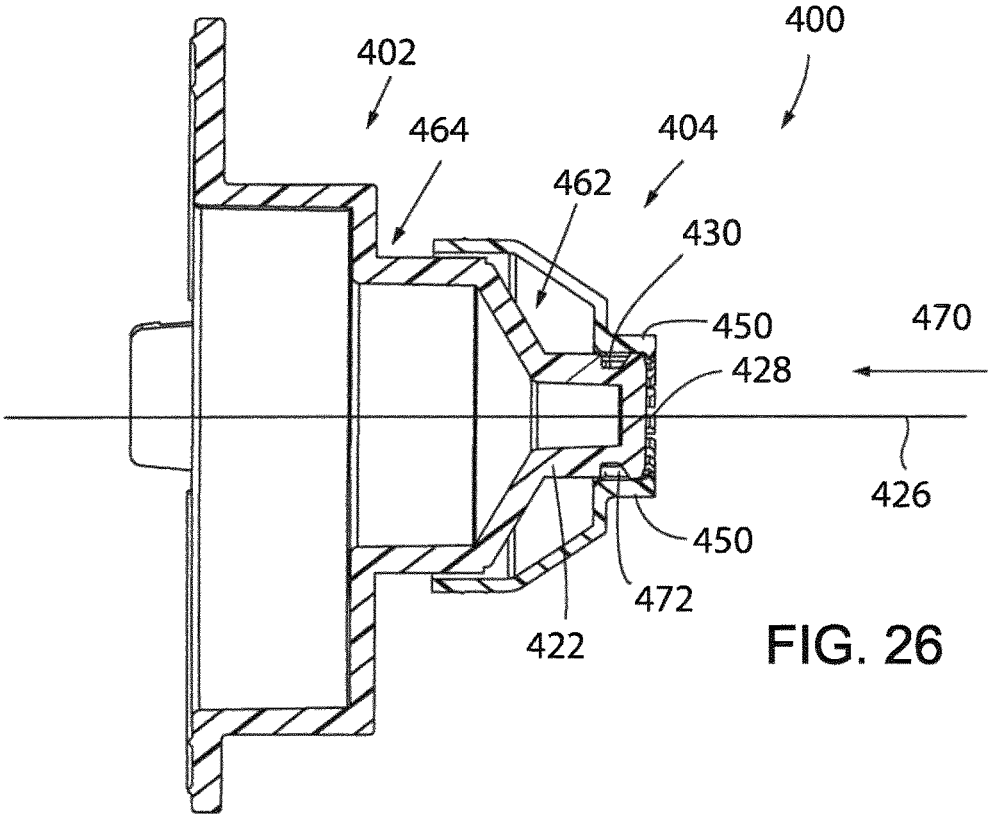
FIG. 26 is a view similar to FIG. 25 and shows the insert partially engaged with the hub to effectuate the desired axial alignment therebetween.
Figure 27:
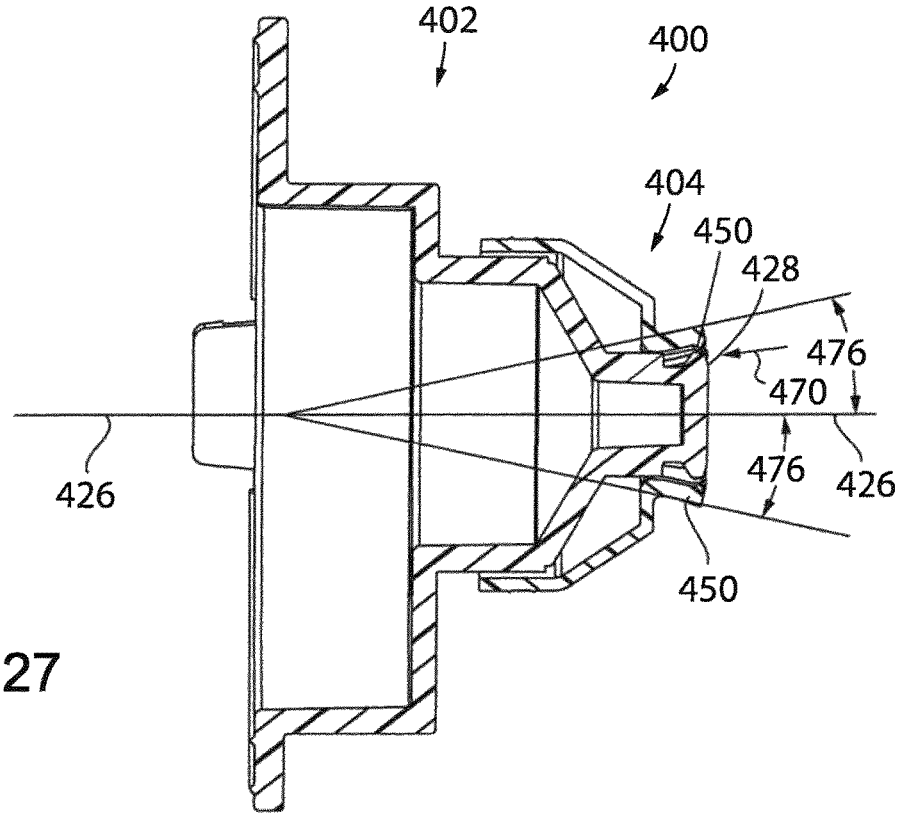
FIG. 27 is a view similar to FIG. 26 and shows the insert engaged with the hub sufficiently to effectuate displacement of the restraint members.

Referring to FIGS. 24 and 25, engagement interface 418 of insert 404 includes a plurality of retainers or fingers 450 that extend from body 438 of insert 404 in a cantilevered manner between a support end 452 and a distal or free end 454 associated therewith. A projection 460 extends in an inward radial direction toward axis 426 from one or more of fingers 450 and preferably from each of fingers 450. Referring to FIG. 25, insert 404 includes a radially inward directed cavity 462 that axially cooperates with a roll facing end portion 464 of hub 402. Referring to FIG. 26, during axial translation of insert 404 toward hub 402, as indicated by arrow 470, distal end 428 of post 422 is shaped to slidably cooperate with a cavity 472 defined by the circumference of fingers 450.

The slidable cooperation of post 422 with cavity 472 provides axial alignment of hub 402 relative to insert 404 during placement of a roll associated therewith relative to the underlying dispenser assembly 128. Continued axial translation of insert 404 relative to hub 402 in direction 470 allows distal end 428 of hub 402 to deflect discrete retainers or fingers 450 in outward radial directions, indicated by arrow 476, until discrete projections 460 associated with fingers 450 seat or otherwise slidably cooperate with channel 430 defined by hub 402 such that insert 404 is axially positioned relative to hub 402 and such that distal end 428 associated with post 422 is oriented laterally outboard relative to insert 404. Although post 422 extends through insert 404, it should be appreciated that the distal end 428 of post 422 is oriented in the bore associated with the roll of web material associated with insert 404.

Figure 28:
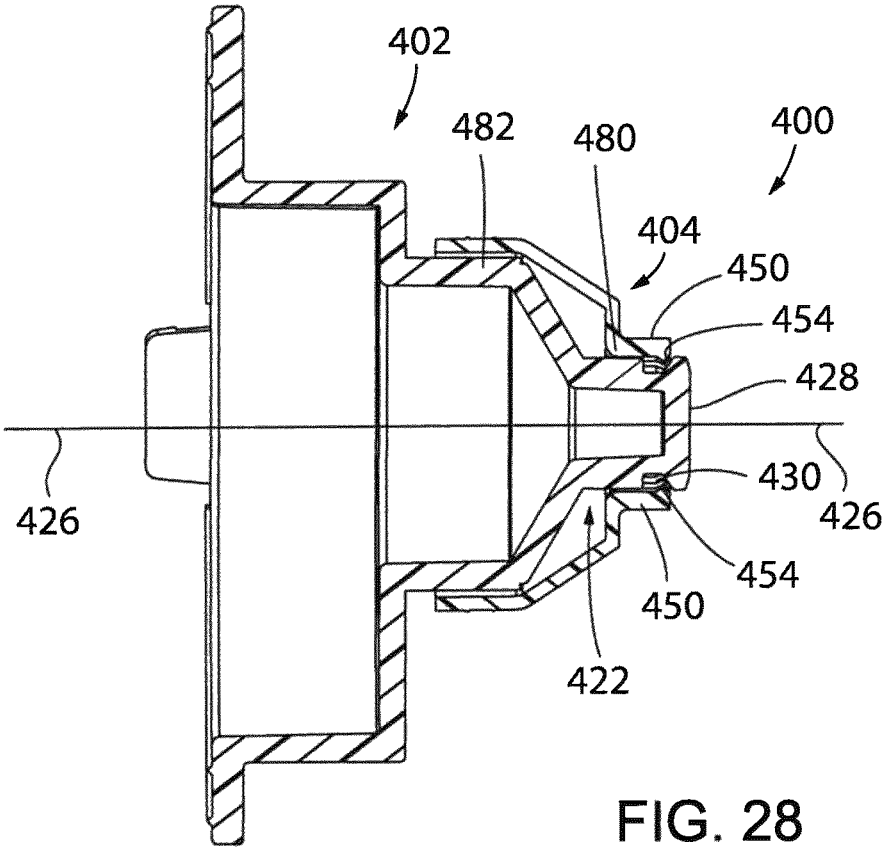
FIG. 28 is a view similar to FIG. 27 and shows the hub and insert engaged with one another such that the restraint members inhibit axial translation between the insert and the hub but accommodate rotational interaction therebetween.
Figure 29:
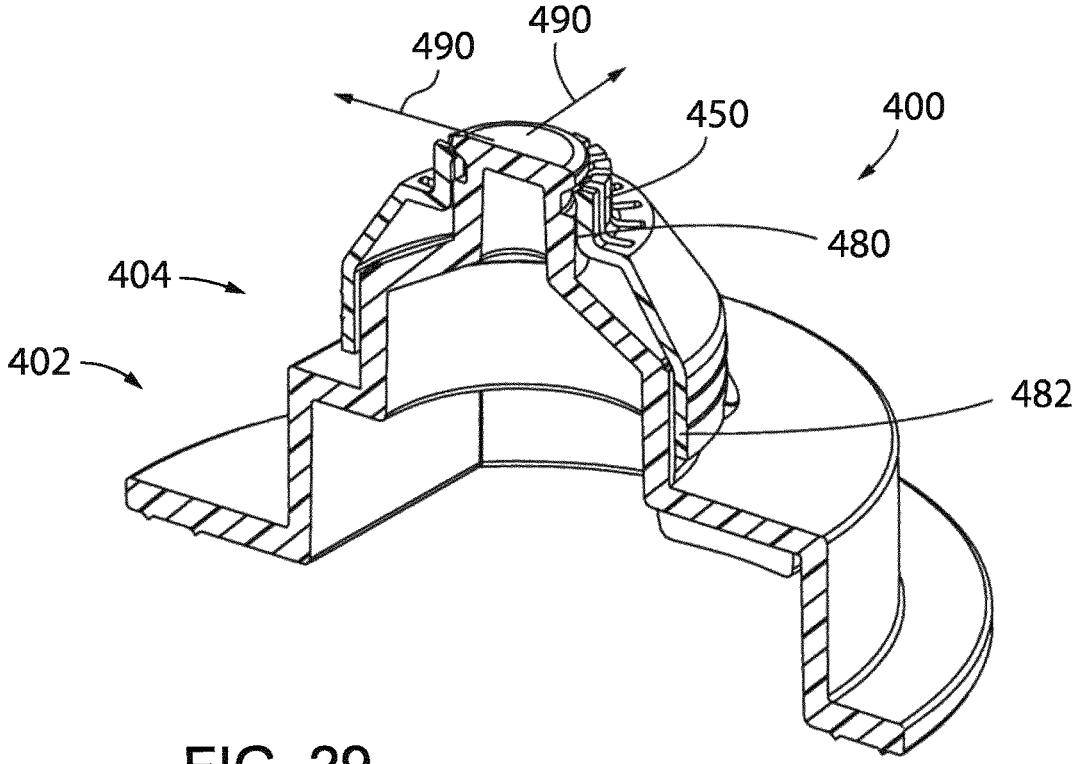
FIG. 29 is a perspective view of the cross sectional view and degree of engagement between the hub and the insert shown in FIG. 28.

Cooperation of projections 460 with cavity or channel 430 restricts axial translation of insert 404 relative to hub 402 when a respective roll of web material is associated there with. As shown in FIG. 28, a first bearing surface 480 and a second bearing surface 482 are formed between the respective adjacent facing surfaces of insert 404 and hub 402. It should be noted that, like roll lockout system 300, bearing surface 480 of roll lockout system 400 is radially nearer axial centerline 426 than bearing surface 482. It should also be noted that in addition to the radial spacing of bearing surfaces 480, 482, bearing surface 480 and bearing surface 482 are also offset relative to one another along axis 426. Such a construction provides stable rotational support between insert 404, and a roll of web material associated therewith, and the hub 402 associated with the respective underlying dispenser assembly and/or respective support arm 22, 122 associated therewith and as disclosed further above.

Like roll lockout system 300, is appreciated that the construction and orientation of the plurality of retainers or fingers 450 associated with roll lockout system 400 can similarly be provided in numerous configurations. Upon consumption of a discrete roll of web material associated with dispenser assembly 128 and supported by lockout system 400, user manipulation of insert 404 allows fingers 450 to deflect in respective outward radial directions, indicated by arrows 490, to facilitate the removal or disengagement of a discrete insert 404 from the relative underlying hub 402 to accommodate replacement, replenishment, or re-loading of dispenser assembly equipped with hub 402 with a roll of web material having an insert 404 associated with its bore and thereby correlating to an authorized respective roll of web material.

Like roll lockout system 300, is further appreciated that roll lockout system 400 can be configured with other radially spaced and/or numbers of deflectable retainers or fingers and/or numbers and constructions other than that which is shown in the drawings. For instance, it is appreciated that fingers 450 may be provided in other radial shapes or sizes and/or have projections 460 associated therewith and/or configured to cooperate with a respective portion of insert 404 so as to facilitate the rotational cooperation therebetween, the axially indexed relative position therebetween, and do so in a manner that mitigates axial dissociation or translation of insert 404, and the roll of web material associated therewith, relative to hub 402, during use of the underlying dispenser assembly. It is envisioned that three fingers 450 may be provided and may be provided to extend a similar or dissimilar circumferential distance about channel 430 and be spaced about the circumference thereof so as to maintain the desired rotational cooperation between hub 402 and a respective insert 404 associated therewith and without negating the manually separable cooperation of insert 404 with post 422 upon consumption or use of a discrete roll of discrete web material. These and other aspects of the present invention are encompassed by the scope of the appending claims.

Figure 30:
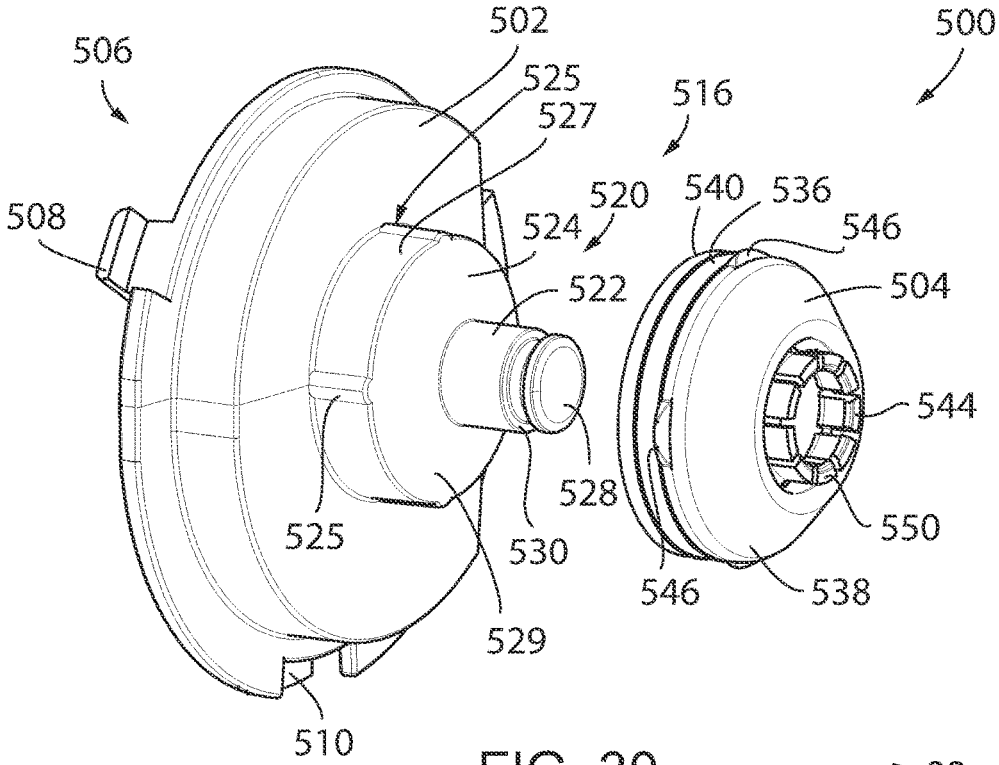
FIG. 30 is a perspective view similar to FIG. 24 and shows a lockout system according to another embodiment of the present invention with an insert and hub thereof exploded from one another.
Figure 31:
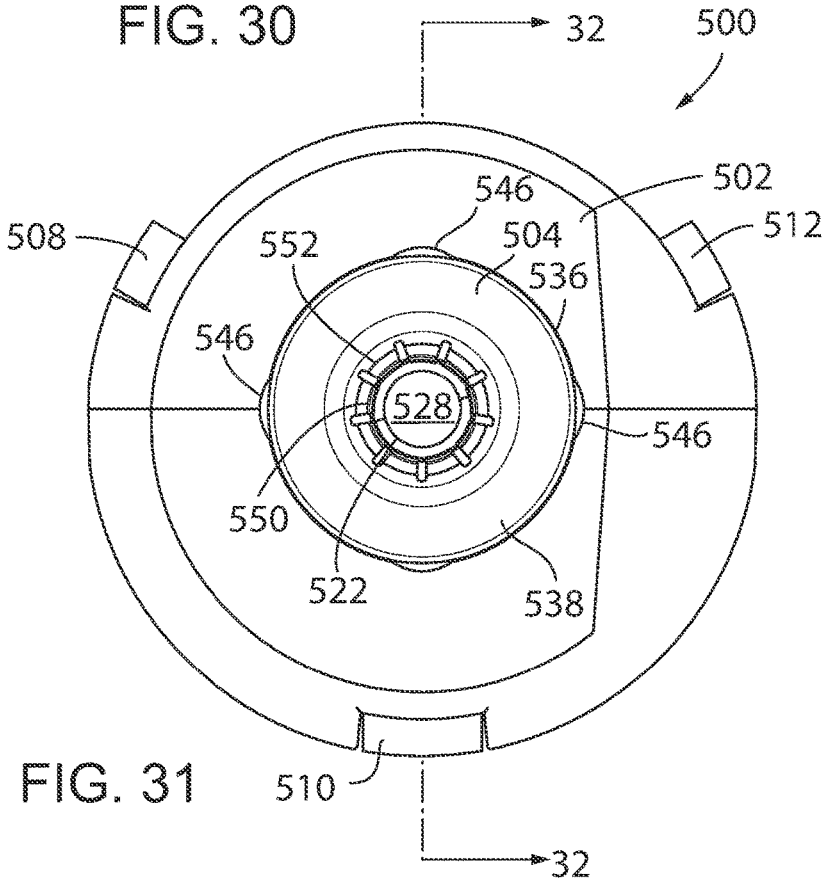
FIG. 31 is an axial elevation end view of the lockout system shown in FIG. 30 with the insert engaged with the hub.

FIGS. 30-33 show a roll lockout assembly or system 500 according to another embodiment of the present invention. It should be appreciated that roll lockout assembly or system 500 has a construction generally similar to lockout system 400. Referring to FIGS. 30 and 31, lockout system 500 includes a hub 502 that is constructed to removeably cooperate with an insert 504. Hub 502 includes a dispenser facing side 506 having one or more projections 508, 510, 512 that are constructed to tool-lessly and preferably snap-fittingly, wholly or partially rotatably, or otherwise selectively removeably cooperate with a roll support arm such as support arms 22, 122 has disclosed above. It is appreciated that the size and shape of that portion of hub 502 that is constructed to engage the respective support arm could be provided in various sizes and shapes and constructed to cooperate with support arms having various constructions.

Hub 502 includes an engagement interface 516 that is constructed to rotationally support and axially cooperate with an engagement interface 518 associated with insert 504. Engagement interface 516 associated with hub 502 includes a first portion 520 that is generally defined by a post 522 that extends in an axial direction from a barrel portion 524 of hub 502 along an axis of rotation about axis 526 associated with the axis of rotation associated with a roll of web material supported by lockout system 500. Post 522 extends along axial direction of axis 526 between barrel portion 524 and a distal end 528 defined by post 522. A channel 530 is formed proximate the cantilevered free end or distal end 528 of post 522 and is constructed a snap-fittingly cooperate with engagement interface 518 as disclosed further below.

Barrel portion 524 of hub 502 includes an outer radial portion 527 that extends an axial direction along axis 526 from the hub facing end of post 522. A shoulder 529 is defined by hub 502 and includes one or more ribs 525 that extend in axial direction 526 along the surface associated with radial portion 527 and cooperate with the radially inward facing or directed surface of insert 504 when insert 504 is engaged with hub 502. Channel 530 formed in post 522 proximate distal end 528 is constructed to axially cooperate with engagement interface 518 of insert 504. Insert 504 includes an outwardly directed radial surface 536 of a body 538 that defines insert 504 between the hub facing end 540 and an opposing end 544 of insert 504. One or more optional projections 546 extend in a generally outward radial direction relative to surface 536 to secure insert 504 relative to the bore defined by a roll of web material, such as roll 326, as disclosed above and as shown in FIGS. 18 and 19.

Figure 32:
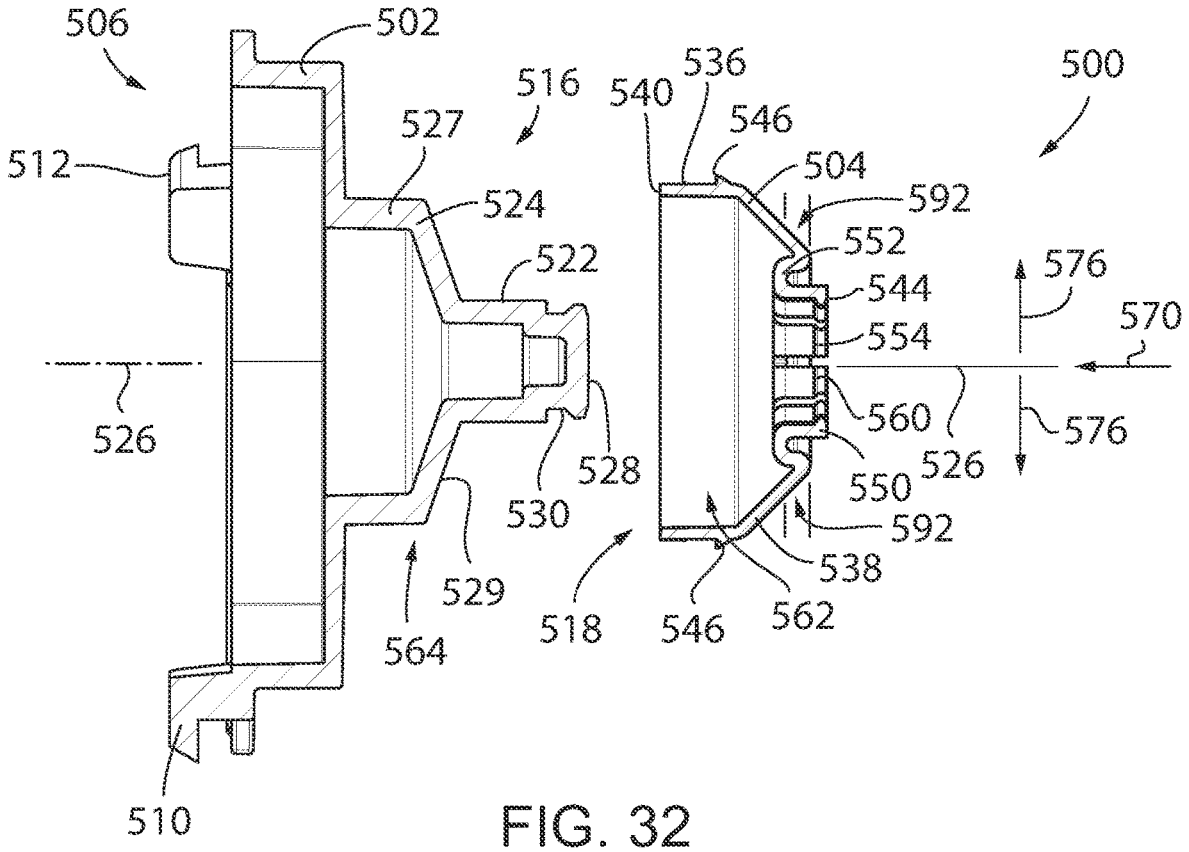
FIG. 32 is a radial cross section elevation view taken along line 32-32 of the lockout system shown in FIG. 30 with the insert positioned for engagement with the hub.
Figure 33:
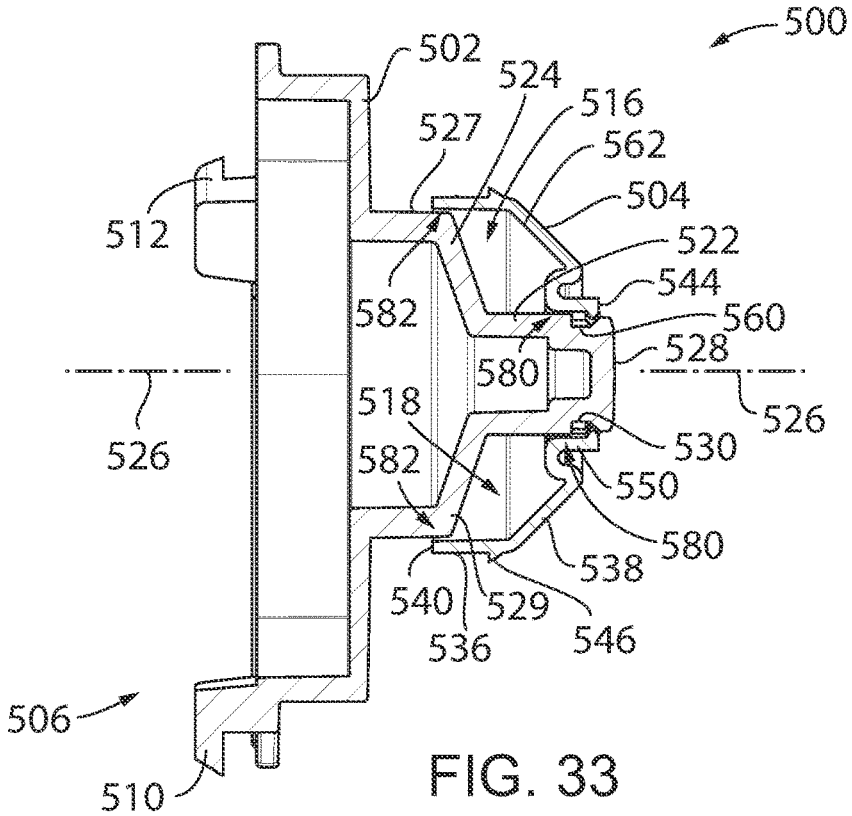
FIG. 33 is a view similar to FIG. 32 with the insert engaged with the hub.

Referring to FIGS. 30, 32, and 33, like insert 404, engagement interface 518 of insert 504 includes a plurality of retainers or fingers 550 that extend from body 538 of insert 504 in a cantilevered manner between a support end 552 and a distal or free end 554 associated therewith. A number of projections 560 extend in a generally inward radial direction toward axis 526 from one or more of fingers 550 and preferably from each of fingers 550. As shown in FIGS. 32 and 33, insert 504 includes a radially inward directed cavity 562 that axially cooperates with a roll facing end portion 564 of hub 502 when hub 502 and insert 504 are engaged with one another. During axial translation of insert 504 toward hub 502, as indicated by arrow 570, distal end 528 of post 522 is shaped to slideably and preferably snap-fittingly cooperate with a cavity 572 defined by the circumference of fingers 550.

The slideable cooperation of post 522 with cavity 572 provides axial alignment of hub 502 relative to insert 504 during placement of a roll associated therewith relative to the underlying dispenser assembly 128. Continued axial translation of insert 504 relative to hub 502 in direction 570 allows distal end 528 of hub 502 to deflect discrete retainers or fingers 550 in outward radial directions, indicated by arrow 576, until discrete projections 560 associated with fingers 550 seat or otherwise slideably cooperate with channel 530 defined by hub 502 such that insert 504 is axially positioned relative to hub 502 and such that distal end 528 associated with post 522 is oriented laterally outboard relative to insert 504. Although post 522 extends through insert 504, it should be appreciated that the distal end 528 of post 522 is oriented in the bore associated with the roll of web material associated with insert 504. Like the lockout systems disclosed heretofore, when insert 504 and hub 502 are engaged with one another such that projections 560 associated with fingers 550 are engaged with channel 530 defined by hub 502, rotational interaction of insert 504 and the roll of web material associated therewith relative and relative to hub 502, is provided in a manner allows the roll of web material to be rotated but with limited free rotation therebetween after each dispense event. Such considerations mitigate instances of dispensing more web material than is desired.

Cooperation of projections 560 with cavity or channel 530 restricts axial translation of insert 504 relative to hub 502 when a respective roll of web material is associated therewith and without being acted upon by outside forces, such as a user's removal of remainder of a mostly consumed roll of web material. As shown in FIG. 33, hub 502 and insert 504 cooperate with one another in a manner similar to hub 402 and insert 404 to define a first bearing surface 580 and a second bearing surface 582 that are formed between the respective adjacent radially facing surfaces of hub 502 and insert 504. It should be noted that, like roll lockout systems 300, 400 disclosed above, bearing surface 580 of roll lockout system 500 is radially nearer axial centerline 526 than bearing surface 582. It should also be noted that in addition to the radial spacing of bearing surfaces 580, 582, bearing surface 580 and bearing surface 582 are also offset relative to one another along axis 526. Such a construction provides stable rotational support between insert 504, and a roll of web material associated therewith, and the hub 502 associated with the respective underlying dispenser assembly and/or respective support arm 22, 122 associated therewith and as disclosed further above. Bearing surfaces 580, 582 further each provide a generally circumferential rotationally supported interaction between hub 502 and insert 504 when associated with one another and do so in a manner that offsets the rotational support between hub 502 and insert 504 from the axial indexing cooperation associated with the cooperation of projections 560 with channel 530. Such considerations provide robust rotational support between hub 502 and insert 504 to better accommodate the mass of a full roll of web material when associated therewith.

Like roll lockout systems 300, 400, it is appreciated that the construction and orientation of the plurality of retainers or fingers 550 associated with roll lockout system 500 can similarly be provided in numerous configurations. Upon consumption of a discrete roll of web material associated with dispenser assembly 128 and supported by lockout system 500, user manipulation of insert 504 allows fingers 550 to deflect in respective outward radial directions, indicated by arrows 576, to facilitate the removal or disengagement of a discrete insert 504 from the relative underlying hub 502 to accommodate replacement, replenishment, or re-loading of dispenser assembly equipped with hub 502 with a roll of web material having an insert 504 associated with its bore and thereby correlating to an authorized respective roll of web material.

Like roll lockout systems 300, 400, is further appreciated that roll lockout system 500 can be configured with other radially spaced and/or numbers of deflectable retainers or fingers and/or numbers and constructions other than that which is shown in the drawings. For instance, it is appreciated that fingers 550 may be provided in other radial shapes or sizes and/or have projections 560 associated therewith and/or configured to cooperate with a respective portion of insert 504 so as to facilitate the rotational cooperation therebetween, the axially indexed relative position therebetween, and do so in a manner that mitigates axial dissociation or translation of insert 504, and the roll of web material associated therewith, relative to hub 502, during use of the underlying dispenser assembly. It is envisioned that as few as two fingers 550 may be provided and may be provided to extend a similar or dissimilar circumferential distance about channel 530 and be spaced about the circumference thereof so as to maintain the desired rotational cooperation between hub 502 and a respective insert 504 associated therewith and without negating the manually separable cooperation of insert 504 with post 522 upon consumption or use of a discrete roll of discrete web material. It should be appreciated that, due to the similarities in their size and constructions, inserts 304, 404, 504 can each preferably be constructed to interchangeably cooperate with one, more than one, or each of respective hubs 302, 402, 502.

Referring to FIGS. 30, 32, and 33, unlike the inserts associated with roll lockout systems 300, 400, body 538 of insert 504 of roll lockout system 500 includes an overlapping portion 592 wherein body 538 of insert 504 has a generally S or Z shaped cross-sectional shape as the cross-section of insert 504 progresses between end 544 associated with fingers 550 and hub facing end 540. Although shown as being generally axially aligned with bearing surface 580 when insert 504 is engaged with hub 502, it is appreciated that overlapping portion 592 of insert 504 is may be disposed in alignment with bearing surface 582 or disposed between bearing surfaces 580, 582. It should be appreciated that overlapping portion 592 of insert 504 is disposed between bearing surfaces 580, 582 in both the axial direction associated with axis 526 and the radial direction as indicated by arrows 576.

Preferably overlapping portion 592 is formed toward the hub directed side of insert 504 relative to axis 526 and relative to end 544 thereof. That is to say, although insert 504 could be constructed such that overlapping portion 592 be oriented axially outboard of each of bearing surfaces 580, 582, overlapping portion 592 preferably shaped and positioned to be axial aligned or overlapping in radial directions one of bearing surfaces 580, 582 or located axially therebetween. Regardless of the relative location, overlapping portion 592 is constructed to maintain the deflectable nature associated with operation of fingers 550 relative to hub 502, facilitate initial alignment of an insert 504 equipped roll of web material with hub 502, attain the desired engagement of a roll of web material with the dispenser—and removal of any residual portion associated with a previously consumed roll of web material, and do not otherwise interfere with or detract from the dual bearing surface 580, 582 rotational support associated with the rotational dispensing engagement provided by the selectively severable association of insert 504 and hub 502.

FIGS. 34-37 disclose a roll lockout system 600 according to yet another embodiment of the application. Like the lockout systems disclosed above, lockout system 600 includes a hub 602 that is constructed to selectively cooperate with an insert such as insert 504 as disclosed above. As such, like reference numbers are used hereafter with respect to the construction of insert 504. As disclosed above, insert 504 is constructed to cooperate with a bore 607 of a roll of web material 609 such that, when disposed therein, insert 504 is preferably rendered non-removable from roll of web material 609 save for the depletion thereof and/or destruction of any residual portion of the respective roll of web material such that insert 504 can be considered reusable, recyclable, and/or disposable.

Unlike the lockout systems disclosed heretofore, hub 602 cooperates with a support arm or support arm assembly such that the same is rendered movable relative thereto. As shown, hub 602 cooperates with a support assembly that includes a support arm 606 and a carriage 608 that is engaged therewith. Support arm 606 is defined by a body 610 that is constructed to engage a housing such as housing 202 (FIG. 17) in a manner according to one or more of the methodologies disclosed above. Preferably, body 610 of support arm 606 is constructed to snap-fittingly cooperate with the respecting housing such that a forward oriented hub supporting portion of body 610 is offset from the interior facing surfaces of the housing and such that roll of web material 609 can be supported by hub 602 when hub 602 is engaged with support arm 606.

A passage 612 is formed through body 610 of support arm 606 and is shaped to cooperate with respective portions of carriage 608 and hub 602 associated therewith as disclosed further below. One or more openings 614, 616, 618, 620 are formed through body 610 of support arm 606 and are generally disposed about passage 612. One or more handles or tabs 622, 624 extend in an outward radial direction from body 610 relative to passage 612. Tabs 622, 624 are generally accessible to the user to facilitate user interaction with support arm 606 and a respective core or cigar associated with a sufficiently depleted roll of web material 609 to assist with the selective separation between hub 602 and the core or any portion of a spent roll of web material 609 that may be associated therewith during reloading of a dispenser assembly equipped therewith.

Figure 35:
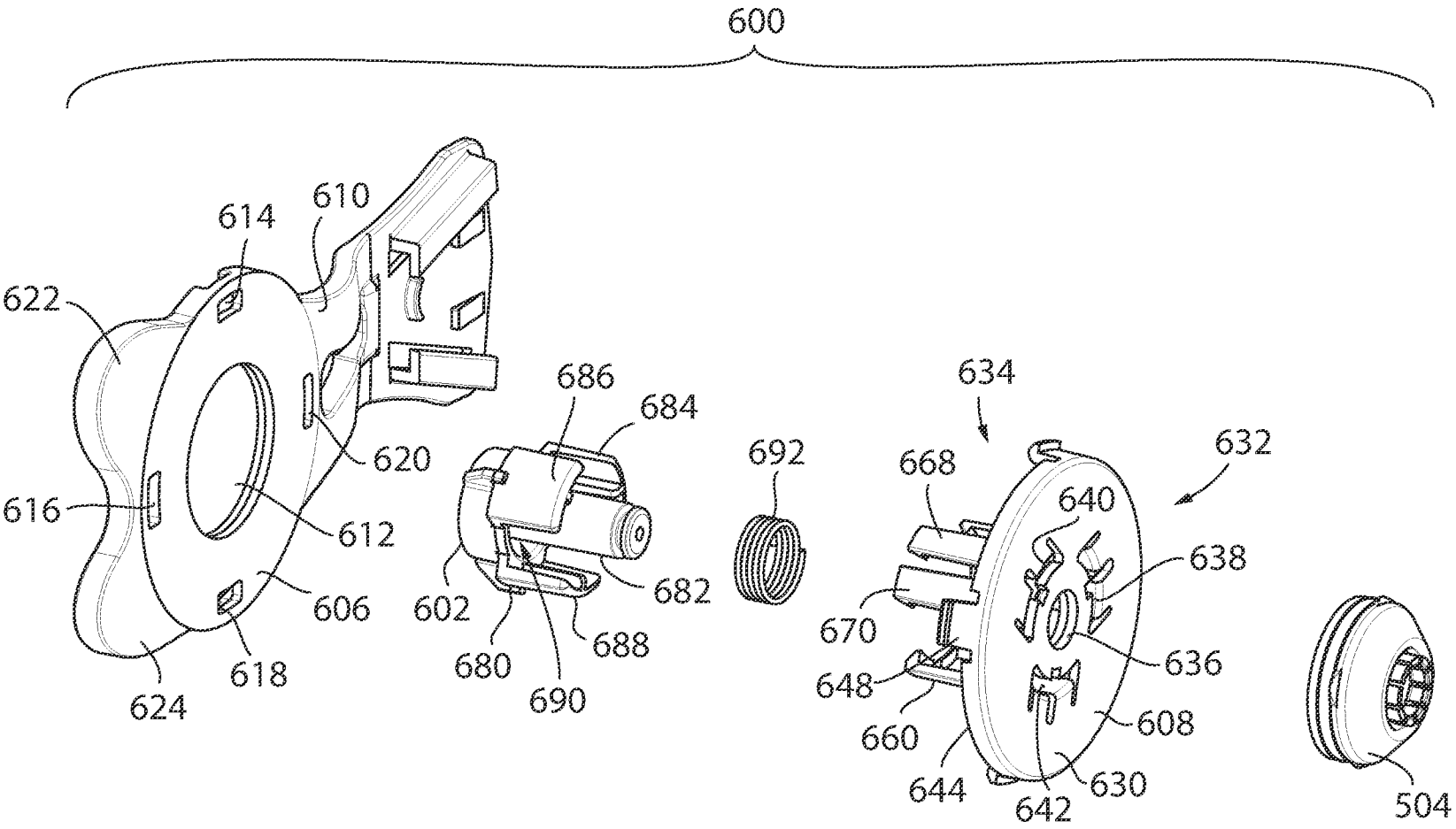
FIG. 35 is an exploded perspective view of the lockout system shown in FIG. 34 from a roll facing side thereof.
Figure 36:
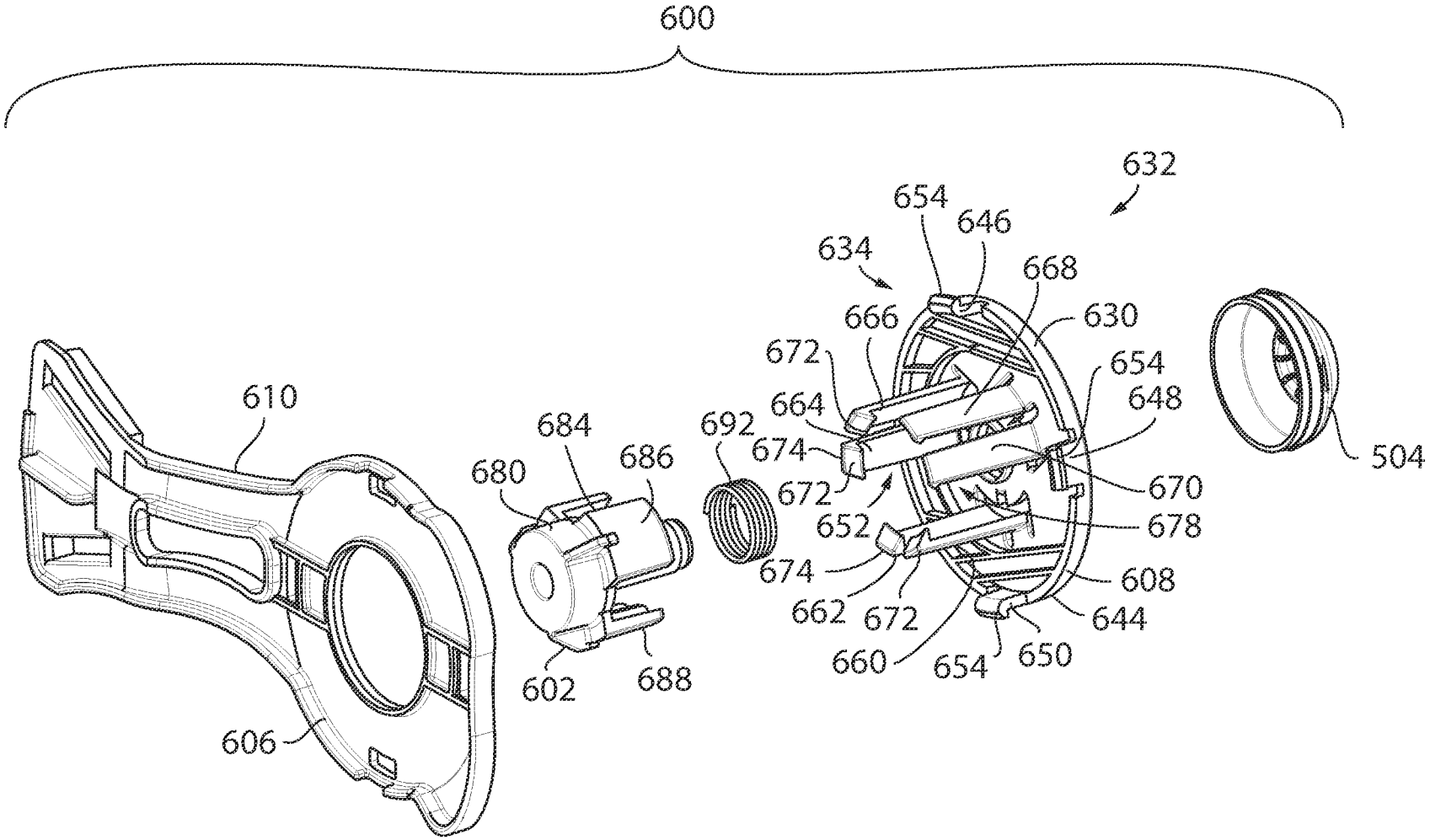
FIG. 36 is an exploded perspective view of the lockout system shown in FIG. 34 from the dispenser housing facing side thereof.

Referring to FIGS. 35 and 36, carriage 608 is defined by a body 630 having a roll or insert facing side or surface 632 and a support arm facing side 634. A passage 636 and one or more openings 638, 640, 642 are formed through body 630 of carriage 608. Openings 638, 640, 642 are generally disposed circumferentially about passage 636 such that each of passage 636 and openings 638, 640, 642 are fluidly isolated from one another and preferably circumferentially bounded by body 630 of carriage 608. As disclosed further below, such a construction maintains a relative rotational orientation of hub 602 relative to carriage 608 when hub 602 is associated therewith and in a manner that accommodates selective axial translation of hub 602 relative to carriage 608 in the manner disclosed further below.

A wall 644 is generally formed about a perimeter of body 630 and includes one or more projections 646, 648, 650, 652 that extend in an outward axial direction toward support arm 606. A catch 654 is formed proximate the distal end of each projection 646, 648, 650, 652. Catches 654 and projections 646, 648, 650, 652 are constructed and oriented to cooperate with respective openings 614, 616, 618, 620 defined by support arm 606 such that carriage 608 snap fittingly cooperates therewith such that carriage 608 is positionally fixed relative to support arm 606 when engaged therewith. A plurality of projections or arms 660, 662, 664, 666, 668, 670 extend in a rearward axial direction relative to support arm facing side 634 of carriage 608 and are disposed radially proximate openings 638, 640, 642 thereof. A barb 672 is formed near the free or distal end 674 of one or more of arms 660, 662, 664, 666, 668, 670. Arms 660-670 are radially spaced from one another and oriented so as to generally define a hub cavity 678 therebetween. Arms 660-670 are deflectable to accommodate association or placement of hub 602 within hub cavity 678 and have an at-rest orientation wherein barbs 672 overlap the radial footprint of hub 602 once hub 602 is position therein. As should be appreciated from FIG. 36, hub 602 is insertable into hub cavity 678 from a direction facing support arm 606 such that, once assembled, removal of hub 602 from hub cavity 678 in a direction toward the roll cavity of the dispenser cavity is prevented. As disclosed further below, hub cavity 678 is shaped to support hub 602 such that hub 602 is axially moveable or slideable therein relative to carriage 608.

Figure 34:
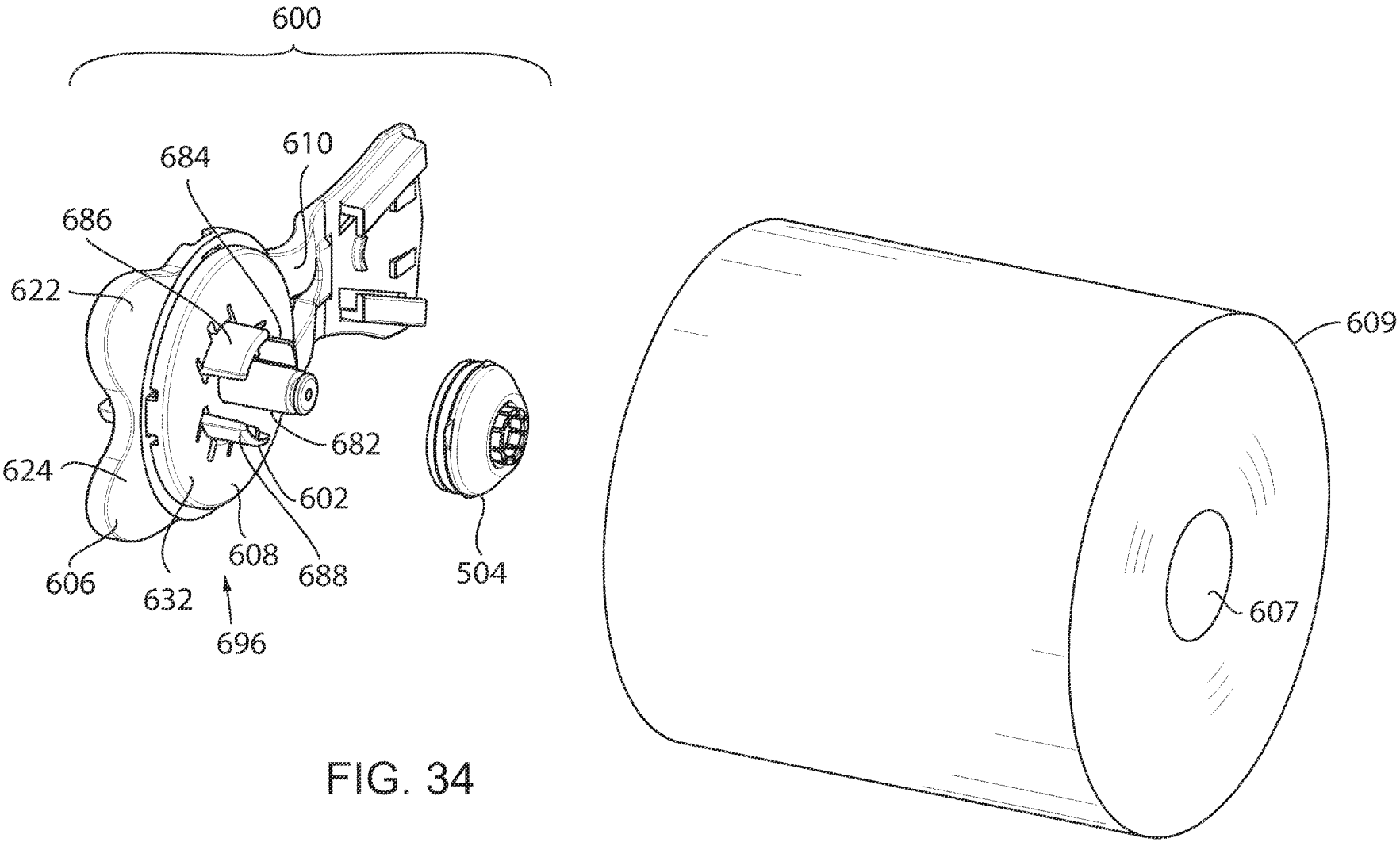
FIG. 34 is a view similar to FIG. 19 of a lockout system according to another embodiment of the present invention.

Still referring to FIGS. 35 and 36, hub 602 is defined by a body 680 having a post 682 and one or more projections 684, 686, 688 that are disposed circumferentially thereabout. Body 680 of hub 602 defines a cavity 690 that is disposed between a portion of post 682 and generally bounded by projections 684, 686, 688. Cavity 690 is shaped to cooperate with a biasing device, such as a spring 692 or the like. When assembled, opposing ends of spring 692 cooperate with carriage 608 and hub 602 to urge hub 602 and carriage 608 toward one another. When assembled, biasing device 692 biases hub 602 relative to carriage 608 and support arm 606 toward an orientation wherein post 682 of hub 602 passes through passage 636 of carriage 608 and extends axially beyond roll facing surface 632 of carriage 608. When oriented in such a position, projections 684, 686, 688 of hub 602 pass through respective openings 638, 640, 642 defined by body 630 of carriage 608 and similarly extend axially beyond roll facing surface 632 of carriage 608 such that post 682 and projections 684, 686, 688 are each available for interaction with insert 504. Such an orientation is shown in FIG. 34 wherein post 682 and projections 684, 686, 688 associated with hub 602 are oriented in an exposed or accessible orientation 696 available for interaction with insert 604 and a respective roll of web material 609 associated therewith.

Figure 37:
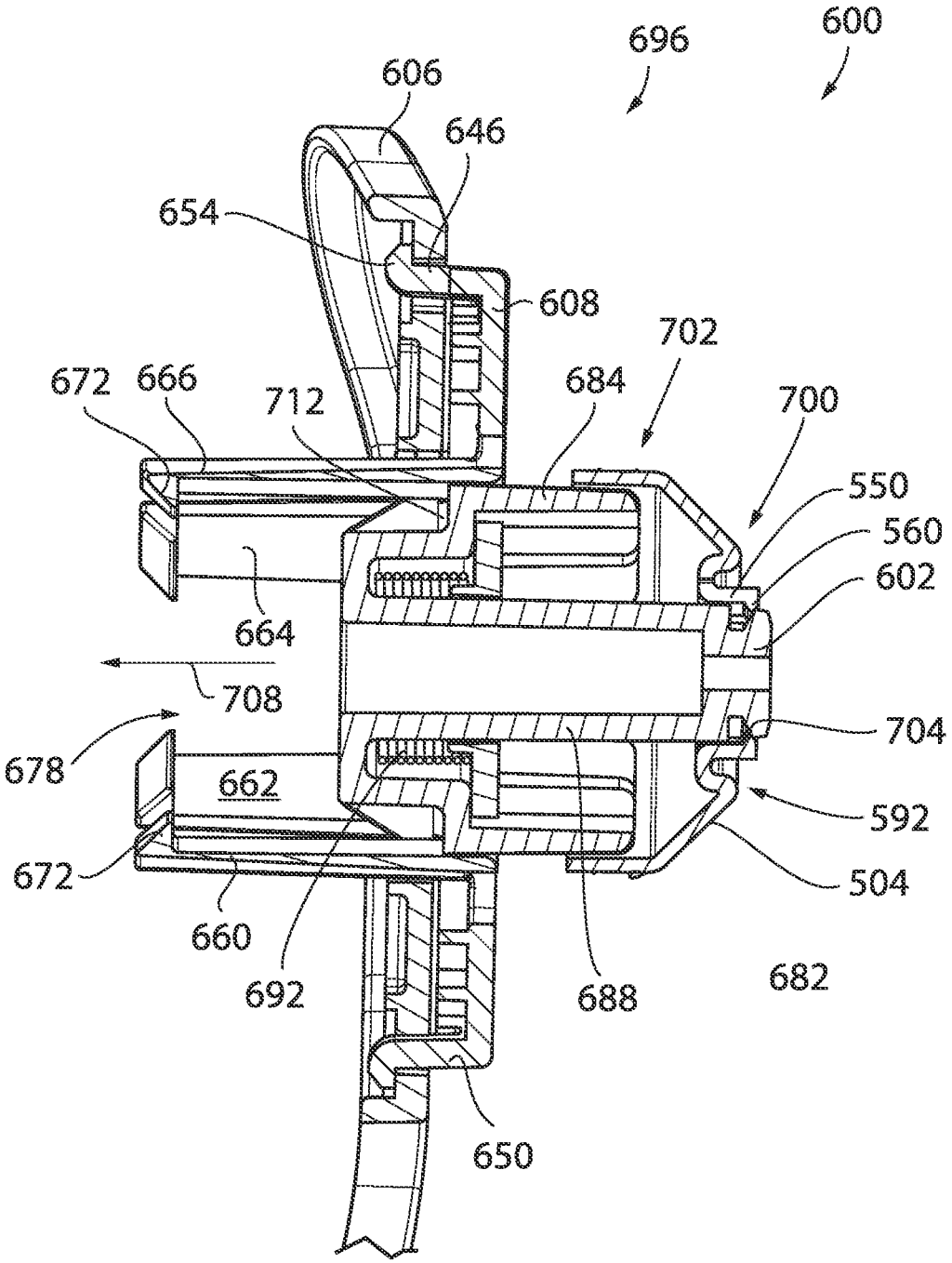
FIG. 37 is a radial cross section elevation view of the lockout system shown in FIG. 34 with the insert engaged with the hub.

Referring to FIG. 37, when oriented in the accessible orientation 696, post 682 defines a first bearing surface or interface 700 associated with interaction with insert 504 and projections 684, 686, 688 define a second bearing surface or interface 702 associated with engaging a respective insert 504 having a suitable construction is fully engaged therewith such that the projections 560 associated with respective fingers 550 are engaged with a channel 704 defined by post 682. Overlapping portion 592 of insert 504 rotationally cooperates with an exterior surface of post 682 and a radially outward directed surface of projections 684, 686, 688 rotationally cooperates with a radially inward facing surface of insert 504. It is appreciated that the relative position and construction of bearing surfaces 700, 702 and overlapping portion 592 associated with the cooperation and engagement of insert 504 and hub 602 can be provided in any of the alternate relative constructions, relative to one another and/or each other, as disclosed above with respect to the cooperation of insert 504 with hub 502. Regardless of the relative configuration therebetween, biasing device 692 provides sufficient force to tolerate the slideable association of insert 504 with hub 602 such that projections 560 defined by insert 504 can achieve operative engagement with channel 704 defined by hub 602 when an insert constructed for operative engagement with hub 602 is associated therewith.

If however a user attempts to associate or otherwise engage a roll of web material having an improperly configured insert with hub 602, such action translated hub 602 in an axial or lateral direction, indicated by arrow 708, relative to carriage 608 within hub cavity 678 such that post 682 and projections 684, 686, 688 will retract through the passage and openings defined by carriage 608, and against the bias of spring 692, such that hub 602 is rendered no longer available or exposed for interaction with such an insert. Barbs 672 associated with arms 660, 662, 664, 666, 668, 670 prevent undesired separation between hub 602 and carriage 608 during such instances and are oriented to interact with a stop 712 defined by body 680 of hub 602. Barbs 672 and stop 712 are configured and oriented to prevent continued lateral displacement of hub 602 relative to carriage 608 and to maintain the desired slideable association between post 682 and projections 684, 686, 688 of hub 602 with passage 636 and openings 638, 640, 642 of carriage 608, respectively.

During dissociation of the conflicting insert from interaction with hub 602, biasing device 692 acts to return hub 602 from retracted positions relative to carriage 608 toward the exposed, available, or accessible configuration 696 as the conflicting insert is moved or otherwise dissociated from interaction with hub 602. As such, when an appropriately configured insert 504 is associated with hub 602, the interface therebetween provides a configuration having multiple bearing supports and a methodology that prevents use of dispenser assemblies equipped with hub 602 for use with rolls of web material having inserts that are improperly configured for suitable rotation interaction with hub 602 by physical movement of hub 602 to positions wherein the hub is rendered unavailable for interaction with such inserts.

Therefore, a web material roll lockout assembly according to the present application discloses a hub that is constructed to be supported by a dispenser. An insert is constructed to rotationally cooperate with the hub when the insert is disposed in a bore of a roll of web material and the roll of web material is associated with the dispenser. A channel is formed in a surface of one of the hub and the insert. The surface having the channel faces the other of the hub and the insert when the hub and the insert are rotationally engaged with one another. At least one projection is defined by the other of the hub and the insert and oriented to cooperate with the channel to resist axial translation between the hub and the insert when the projection is disposed in the channel.

Another aspect of the present application discloses a method of restricting rolls of web material that can be dispensed from a roll dispenser. The method includes providing a hub that defines an axis of rotation of a roll of web material associated with the roll dispenser. An insert is provided that has an outer diameter that is constructed to securely engage a bore of a roll of web material. The insert is further constructed to slideably cooperate with the hub such that, when the insert is engaged therewith, cooperation of the insert and the hub restricts axial translation between the hub and the insert and accommodates rotation of the insert relative to the hub during rotation of a roll of web material.

A further aspect of the present application discloses a roll web material dispenser assembly that includes a housing having a cover and a base. The hub is supported by the housing and constructed to support a roll of web material within the housing. An insert is disposed in a bore of the roll of web material. A plurality of retainers are defined by one of the hub and the insert and are movable relative thereto. A projection is associated with a number of the plurality of retainers and, although not required, preferably each retainer. A channel is defined by the other of the hub and the insert and is constructed to receive each projection when the hub is engaged with the insert. Such a construction provides a secure interaction between the roll of web material and the underlying dispenser such that the roll of web material is supported such that it is rotatable relative to the dispenser housing.

Another aspect of the application discloses a web material roll lockout assembly having a hub that is constructed to be supported by a dispenser and an insert constructed to rotationally cooperate with the hub when the insert is disposed in a bore of a roll of web material. A channel is formed in a surface of one of the hub and the insert, wherein the surface having the channel faces the other of the hub and the insert when the hub and the insert are rotationally engaged with one another. At least one projection defined by the other of the hub and the insert is oriented to cooperate with the channel to resist axial translation between the hub and the insert when the projection is disposed in the channel. A first bearing surface and a second bearing are formed between the hub and the insert and are offset from one another such that each of the first bearing surface and the second bearing surface are axially offset from an imaginary plane that is perpendicular to an axis of rotation of the roll of web material that intersects the at least one projection.

Another aspect of the application discloses a method of restricting rolls of web material that can be dispensed from a roll dispenser. The method includes providing a hub that defines an axis of rotation of a roll of web material associated with the roll dispenser. An insert is also provided that has an outer diameter that is constructed to securely engage a bore of a roll of web material. The insert is further constructed to slideably cooperate with the hub such that, when the insert is engaged therewith, cooperation of the insert and the hub restricts axial translation between the hub and the insert and accommodates rotation of the insert relative to the hub during rotation of a roll of web material and defines at least two bearing surfaces between the insert and the hub wherein each of the at least two bearing surfaces are offset in an axial direction from respective longitudinal ends of the insert and the hub.

A further aspect of the present application discloses a roll web material dispenser assembly having a housing that includes a cover and a base. A hub is supported by the housing and is constructed to support a roll of web material within the housing. An insert is disposed in a bore of the roll of web material and a plurality of retainers are defined by one of the hub and the insert and being movable relative thereto. A projection is associated with a plurality of the plurality of retainers and a channel is defined by the other of the hub and the insert and constructed to receive each projection when the hub is engaged with the insert. A first bearing surface and a second bearing surface are defined by the hub and the insert and are offset in an axial direction relative to both one another and the channel.

Another aspect of the application discloses a web material roll lockout assembly having a support arm that is constructed to engage a dispenser housing. A carriage is engaged with the support arm and a hub is supported by the carriage and movable relative to the carriage between an exposed position wherein a portion of the hub is accessible and a retracted position wherein the portion of the hub is inaccessible. A biasing device is configured to bias the hub toward the exposed position and an insert is constructed to be disposed in a bore of a roll of web material and to slideably cooperate with the hub so that the hub engages the insert without translating the hub relative to the carriage to the retracted position.

Another aspect of the present application discloses a method of forming a web material lockout assembly. The method includes forming an insert so that an outer geometric shape allows the insert to be slideably received in a bore of a roll of web material and an inner geometric shape that is shaped to removeably cooperate with a hub supported by a dispenser. The hub is supported so that the hub is slideable relative to the dispenser so that the hub is unavailable for engagement if an insert having a different inner geometric shape is attempted to be associated therewith.

A further aspect of the present application discloses a web material dispenser lockout system that includes a support assembly that is constructed to cooperate with a dispenser housing. A hub slideably engages the support assembly so that the hub is movable between an extended position and a retracted position. A biasing device is engaged with the hub and oriented to bias the hub toward the extended position. An insert is constructed to be disposed in a bore of a roll of web material and has a radially interior facing geometry that allows the insert to cooperate with the hub without translating the hub toward the retracted position.

It is appreciated that various features and aspects disclosed in the present application may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. It is recognized that modifications may be made by one of skill in the art of the invention without departing from the spirit or intent of the invention and, therefore, the invention is to be taken as including all reasonable equivalents to the subject matter of the claims.

What is claimed is:

1. A web material roll lockout assembly comprising:

a hub constructed to be supported by a dispenser;

an insert constructed to rotationally cooperate with the hub when the insert is disposed in a bore of a roll of web material;

a channel formed in a surface of one of the hub and the insert, wherein the surface having the channel faces the other of the hub and the insert when the hub and the insert are rotationally engaged with one another;

a plurality of projections defined by the other of the hub and the insert that are radially spaced from one another and oriented to cooperate with the channel to resist axial translation between the hub and the insert when the projection is disposed in the channel; and a first bearing surface and a second bearing between the hub and the insert that are offset from one another and each of the first bearing surface and the second bearing surface are axially offset from an imaginary plane that is perpendicular to an axis of rotation of the roll of web material that intersects the at least one projection.

2. The web material roll lockout assembly of claim 1 wherein the at least one projection is supported by a finger.

3. The web material roll lockout assembly of claim 2 wherein the finger is deflectable in a primarily radial direction relative to an axis of rotation of the insert.

4. The web material roll lockout assembly of claim 3 wherein the finger is further defined as a cantilever and the at least one projection is disposed at a free end of the finger.

5. The web material roll lockout assembly of claim 1 wherein a portion of the insert that is located relative to an axial direction between the first bearing surface and the second bearing surface has a cross sectional shape that overlaps itself relative to a radial direction.

6. The web material roll lockout assembly of claim 1 wherein the first bearing surface and the second bearing surface are radially and axially spaced from one another.

7. A method of restricting rolls of web material that can be dispensed from a roll dispenser, the method comprising:

providing a hub that defines an axis of rotation of a roll of web material associated with the roll dispenser; and providing an insert that has an outer diameter that is constructed to securely engage a bore of a roll of web material and constructing the insert to slideably cooperate with the hub such that, when the insert is engaged therewith, cooperation of the insert and the hub restricts axial translation between the hub and the insert and accommodates rotation of the insert relative to the hub during rotation of a roll of web material and defines at least two bearing surfaces between the insert and the hub wherein each of the at least two bearing surfaces are offset in an axial direction from respective longitudinal ends of the insert and the hub and relative to structures that restrict axial translation between the hub and the insert when the insert is engaged with the hub.

8. The method of claim 7 further comprising constructing one of the hub and the insert to include a plurality of fingers.

9. The method of claim 8 further comprising constructing more than one of the plurality of fingers to include a projection associated with an end of the respective finger.

10. The method of claim 9 further comprising forming the projection on a free end of the respective finger.

11. The method of claim 9 further comprising constructing more than one of the plurality of fingers to deflect in a primarily outward radial direction during axial translation of the insert relative to the hub.

12. The method of claim 11 further comprising forming a groove in one of the hub and the insert and orienting the groove to receive the projection when the insert and the hub are engaged with one another.

13. The method of claim 7 further comprising forming the insert to include axially overlapping portions proximate at least one of the at least two bearing surfaces.

14. The method of claim 7 further comprising spacing respective ones of the at least two bearing surfaces from one another in both a radial direction and an axial direction.

15. A roll web material dispenser assembly comprising:

a housing having a cover and a base;

a hub supported by the housing and constructed to support a roll of web material within the housing;

an insert disposed in a bore of the roll of web material;

a plurality of retainers defined by one of the hub and the insert and being movable relative thereto;

a projection associated with a plurality of the plurality of retainers;

a channel defined by the other of the hub and the insert and constructed to receive each projection when the hub is engaged with the insert; and a first bearing surface and a second bearing surface defined by the hub and the insert and that are offset in an axial direction relative to both one another and the channel.

16. The roll web material dispenser assembly of claim 15 further comprising a projection associated with at least two of the plurality of retainers.

17. The roll web material dispenser assembly of claim 16 wherein the projection associated with the plurality of retainers is more than two projections and the retainers having the projections are spaced radially about a respective one of the hub and the insert.

18. The roll web material dispenser assembly of claim 15 wherein more than one of the plurality of retainers are deflectable in a crossing direction relative to an axis of rotation of the insert about the hub.

19. A web material roll lockout assembly comprising:

a hub constructed to be supported by a dispenser;

an insert constructed to rotationally cooperate with the hub when the insert is disposed in a bore of a roll of web material;

a channel formed in a surface of one of the hub and the insert, wherein the surface having the channel faces the other of the hub and the insert when the hub and the insert are rotationally engaged with one another;

at least one projection defined by the other of the hub and the insert that is supported by a finger and oriented to cooperate with the channel to resist axial translation between the hub and the insert when the projection is disposed in the channel; and a first bearing surface and a second bearing between the hub and the insert that are offset from one another and each of the first bearing surface and the second bearing surface are axially offset from an imaginary plane that is perpendicular to an axis of rotation of the roll of web material that intersects the at least one projection.

20. A method of restricting rolls of web material that can be dispensed from a roll dispenser, the method comprising:

providing a hub that defines an axis of rotation of a roll of web material associated with the roll dispenser;

providing an insert that has an outer diameter that is constructed to securely engage a bore of a roll of web material and constructing the insert to slideably cooperate with the hub such that, when the insert is engaged therewith, cooperation of the insert and the hub restricts axial translation between the hub and the insert and accommodates rotation of the insert relative to the hub during rotation of a roll of web material and defines at least two bearing surfaces between the insert and the hub wherein each of the at least two bearing surfaces are offset in an axial direction from respective longitudinal ends of the insert and the hub; and constructing one of the hub and the insert to include a plurality of fingers.

* * * * *